US006443873B2

(12) United States Patent
Suzuki

(10) Patent No.: US 6,443,873 B2
(45) Date of Patent: Sep. 3, 2002

(54) EXERCISE THERAPY DEVICE

(75) Inventor: Hironori Suzuki, Tokyo (JP)

(73) Assignee: Mitsubishi Electric Engineering Co., Ltd., Tokyo (JP)

( * ) Notice: Subject to any disclaimer, the term of this patent is extended or adjusted under 35 U.S.C. 154(b) by 0 days.

(21) Appl. No.: 09/734,881

(22) Filed: Dec. 13, 2000

(30) Foreign Application Priority Data

Apr. 26, 2000 (JP) ..... 2000-125037

(51) Int. Cl.[7] ..... A63B 21/00
(52) U.S. Cl. ..... 482/8; 482/1; 482/900
(58) Field of Search ..... 482/1–9, 900–902, 482/148

(56) References Cited

U.S. PATENT DOCUMENTS

| | | | | | |
|---|---|---|---|---|---|
| 4,905,676 | A | * | 3/1990 | Bond et al. | 601/34 |
| 4,934,694 | A | * | 6/1990 | Mcintosh | 601/23 |
| 5,020,795 | A | * | 6/1991 | Airy et al. | 482/8 |
| 5,421,798 | A | * | 6/1995 | Bond et al. | 601/23 |

FOREIGN PATENT DOCUMENTS

| | | |
|---|---|---|
| JP | 56-85366 | 7/1981 |
| JP | 63-130080 | 6/1988 |
| JP | 11-169484 | 6/1999 |
| JP | 11-262542 | 9/1999 |
| JP | 10-179660 | 7/2000 |

* cited by examiner

*Primary Examiner*—Glenn E. Richman
(74) *Attorney, Agent, or Firm*—Leydig, Voit & Mayer, Ltd.

(57) ABSTRACT

An exercise therapy device enables a physically handicapped or aged person to smoothly and continuously perform a pedaling exercise according to the level of his physical strength without overextending himself or herself when he or she undergoes an exercise therapy, to thereby recover his or her exercise function and maintain his or her physical strength. The device is simple in construction, compact in size, light in weight, and can be manufactured at low cost by using only a single actuator which acts as both a load device and an assisting force generating device. The device comprises a drive portion adapted to be manually moved by an exerciser, an actuator connected to the drive portion through a power transmission mechanism, and a control unit for causing the actuator to operate as a load device for providing a load to the drive portion and as an assisting device for providing an assisting force to the drive portion when the drive portion is manually moved by the exerciser.

21 Claims, 14 Drawing Sheets

EXERCISE THERAPY DEVICE

BACKGROUND OF THE INVENTION

1. Field of the Invention

The present invention relates to an exercise therapy device capable of recovering the exercise function of and maintaining the physical strength of a physically handicapped person or an aged person by auxiliarily and passively assisting a rotational movement of each pedal when the person undergoes an exercise therapy.

2. Description of the Related Art

FIG. 14 is a diagram illustrating the configuration of a conventional exercise therapy device disclosed in Japanese Unexamined Patent Application Publication No. Hei 11-169484. In this figure, a pulley 201 is connected to pedals 202, and a pulley 203 is provided between the pulley 201 and a motor 207. A belt 204 is looped between the pulleys 201 and 203, and a pulley 205 is provided in such a way as to be integrally joined to the pulley 203. A belt 206 is looped between the pulley 205 and a motor 207. Magnets 208 and 209 are mounted on the pulleys 201 and 205, respectively. Hall elements 210 and 211 are disposed so as to cooperate with the magnets 208 and 209, respectively, for generating signals each time they detect a corresponding one of the magnets 208 and 209. A computer 212 receives the signals from the Hall elements 210 and 211, for calculating the rotational speeds of the pulleys 201 and 205. A load control device 213 controls the load on the motor 207 in accordance with the rotational speeds calculated by this computer 212.

Next, an operation of this conventional exercise therapy device is described hereinbelow. The rotation of each of the pedals 202 is transmitted to and accelerated by the pulley 205 looped between the pulleys 201 and 203, and then transmitted to the motor 207 by the belt 206. A pulse is outputted from each of the Hall elements 210 and 211 at each rotation of a corresponding one of the pulleys 201 and 205. Then, after calculating the number of the pulses, the computer 212 outputs the pulses to the load control device 213. The load control device 213 determines the rotational speed of the motor 207 in accordance with the number of the pulses, and controls the load on the motor 207.

Further, when different loads are imposed on the left and right legs, respectively, of an exerciser from the left and right pedals, the conventional exercise therapy device repeats an operation of alternately imposing a high load and a low load on the legs of the exerciser so that a phase angle corresponding to a position at which the high load is imposed on one of the legs differs by $\pi$ from a phase angle corresponding to a position at which the low load is imposed on the other leg. That is, now assuming that the high load is imposed on the right leg at an easiest-to-push position when the right pedal is pushed by the right foot, and that a low load is imposed on the left leg at a position (namely, an easiest-to-push position when the left pedal is pushed by the left foot) corresponding to a phase angle, which is changed by $\pi$ from the phase angle corresponding to the easiest-to-push position for the right foot, the load imposed on the right leg is higher than the load imposed on the left leg. This is effective especially in the case where an exerciser wishes to train the right leg.

With the conventional exercise therapy device as constructed above, when the pedal 202 is positioned within a range of rotation angles other than the top dead center and the bottom dead center, a rotational load on the pedal is not reduced. Therefore, when a cerebrally handicapped person or an aged person, whose muscular strength (of, for instance, femoral quadriceps and coxal extensor group) has declined and whose motor nerves are numb, undergoes exercise therapy in a range of rotation angles other than the top dead center and the bottom dead center of the pedal 202, he cannot continuously perform a pedaling exercise at all rotation angles. Further, when a frictional load is generated in a low speed rotation region, a high load is caused by the pedaling exercise, so that an exerciser cannot continuously perform a pedaling exercise at all rotation angles. Thus, there has been a problem in that a physically handicapped person or an aged person can neither recover an exercise function nor maintain physical strength in a satisfactory manner by using an exercise therapy device, such as an ergonomic bicycle.

Thus, to eliminate the above drawback, Japanese Unexamined Patent Application Publication No. Hei 11-169484 proposed an exercise therapy device enabling a physically handicapped person or an aged person to smoothly and continuously perform a pedaling exercise to recover exercise function and maintain physical strength.

This exercise therapy device is able to turn a pedal shaft pulley and an intermediate pulley by an assist drive mechanism when the rotational speed of the pedal shaft pulley is reduced to a preset speed or less by an assist motor.

Further, when the assist motor rotates at a preset speed only in one direction at all times and the assist motor is rotated only in one direction by a one-way clutch fixed onto the motor shaft of this assist motor in the assist drive mechanism, a pulley rotatably attached to the motor shaft is rotated together with the motor shaft. Conversely, when the assist motor rotates in the other direction, the pulley is idled with respect to the motor shaft. The assist motor is connected to the pulley by a secondary assist pulley provided on the rotation shaft of the intermediate pulley through an assist belt. The assist motor is connected to the pedal shaft pulley by a primary assist pulley provided on the rotation shaft of the intermediate pulley through a primary belt.

With such a configuration, a physically handicapped person or an aged person can continuously perform a pedaling exercise at all angles when the person undergoes an-exercise therapy, to recover his exercise function and maintain his physical strength.

Further, the exercise therapy device has a one-way clutch for releasing transmission of rotation movement from: a load motor to a pedal shaft pulley. The assist motor is rotated by a load reduction drive mechanism so that the load motor is rotated to reduce a load in a low speed rotation region.

Furthermore, Japanese Unexamined Patent Application Publication No. 10-179660 discloses an exercise load adjusting device in which an AC generator is used in an exercise load generating portion. The generator is switched to a side, at which the generator is controlled and used as a DC brushless servo motor control, when a set exercise load is equal to or less than a mechanical loss, and the generator is switched to another side, at which a load control is performed on an output of the generator, when the set exercise. load is equal to or more than the mechanical loss. Although this exercise load adjusting device uses only one generator, this generator is used mainly for adjusting an exercise load. when the exercise load is equal to or less than the mechanical loss, the generator serves only to compensate for the mechanical loss. The generator does not act to positively give an exerciser an exercise assisting force.

Among the aforementioned conventional devices, the exercise therapy device described in Japanese Patent Application No. 9-345619 employs two motors, that is, a load for generating a load motor, and an assist motor for generating an assisting force. Therefore, this exercise therapy device needs two power transmission systems for transmitting power from a corresponding one of the motors to a corresponding one of the pedals. Thus, this conventional. exercise therapy device has drawbacks in that the construction thereof is complicated; the number of parts is large; and it is difficult to reduce the size, weight, and cost thereof.

Further, the conventional exercise therapy device described in Japanese Unexamined Patent Application Publication No. 10-179660 does not positively give an exerciser an exercise assisting force. Thus, this conventional exercise therapy device has a drawback in that it is difficult for an exerciser, who is a physically infirm handicapped or aged person, to smoothly and continuously perform a pedaling exercise without overextending himself when an assisting force is needed, for instance, when the person starts to pedal, or in a low speed rotation mode.

SUMMARY OF THE INVENTION

In view of the above, the present invention is intended to eliminate the aforementioned drawbacks of the conventional devices.

Accordingly, an object of the present invention is to provide an exercise therapy device which enables a physically handicapped or aged person to smoothly and continuously perform a pedaling exercise depending upon the level of his physical strength without overextending himself when the person undergoes exercise therapy, to recover the exercised function and maintain physical strength, and which is simple in construction, compact in size and light in weight, and can be manufactured at low cost by using only a single actuator that has a dual function as a load device and an assisting force generating device.

Bearing the foregoing object in mind, according to the present invention, there is provided an exercise therapy device comprising a drive portion adapted to be manually moved by an exerciser, an actuator connected to the drive portion through a power transmission mechanism, and a control unit for causing the actuator to operate as a load device for providing a load to the drive portion and as an assisting device for providing an assisting force to the drive portion when the drive portion is manually moved by the exerciser.

Thus, the exercise therapy device does not require two actuators, that is, a load motor (or generator) for generating a load, and an assisting motor for generating an assisting force, both of which are needed in the conventional devices. A single actuator can serve as both a load motor and an assisting motor. The exercise therapy device of the present invention is effective or advantageous in that the construction of the entire device can be simplified, and that the miniaturization and cost-reduction of the device can be made.

Preferably, the control unit may adjust and limit an assisting force or torque when the actuator is used as an assisting device.

In such a case, the assisting torque is adjusted in accordance with an allowable level for each of individual exercisers. Safety can be assured absolutely or in a manner suitable for each of the individual exercisers by restricting an obviously dangerous force. In the case where the assisting torque is adjusted to a rather low level, the actuator does not operate until an exerciser exerts a certain level of his or her power to move the drive portion. Consequently, the exerciser cannot depend entirely on the assisting force of the actuator. This serves to promote his or her exercise.

Preferably, the control unit may make an assisting force effective, based on a position or a range of rotational angles, at which a mechanical friction of the drive portion is more than a force applied to the drive portion by an exerciser moving the drive portion, or at which the drive portion cannot be driven by physical ability of the exerciser, when the actuator is used as an assisting device.

With such an arrangement, the device compensates for the mechanical friction only in a range in which the exerciser cannot rotate the pedal, instead of the entire range of one revolution of the drive portion, e.g., pedals. Even in the case of an exerciser who cannot continuously perform pedaling because the entire region of rotational angles includes parts, in which the strength of the exerciser (or the greatest force exerted by the exerciser). is less than the magnitude of mechanical friction, and in which degradation in his or her physical strength due to, for instance, hemiplegia, hampers the pedaling by the exerciser, the exercise therapy device of the invention enables him to continuously perform pedaling.

Preferably, when the actuator is used as a load device, the control unit may adjust and limit the speed of the drive portion during an exerciser performs an exercise while moving said drive portion.

In such a case, the exerciser can be prevented from performing pedaling at an excessive speed during his or her exercise. Thus, the exerciser does not pedal at an excessive speed. This prevents him from getting a strain in his leg and getting ill owing to an abrupt and strenuous exercise.

Preferably, when the actuator is used as an assisting device, the control unit may adjust and limit the speed of the drive portion during an exerciser performs an exercise while moving the drive portion.

In such a case, safety can be ensured in absolutely or in a manner suitable for each of the individual exercisers by setting a maximum or limit speed of the drive portion in correlation to a speed at which each exerciser performs an exercise or moves the drive portion, and by preventing the speed of the drive portion from increasing to an obviously dangerous value. Moreover, in the case where the speed generated owing to the assisting torque of the actuator is set in such a manner as to be lower than the pedaling speed to be employed at the exercise, the assisting force can be made to be effective only in a part, in which an exerciser can not perform pedaling because of fatigue or degradation in his strength, of the entire range. Conversely, in a part, in which the exerciser can perform the exercise by himself, he or she may be adapted to perform the exercise by using his or her own strength or force.

Moreover, to obtain a constant pedaling speed during an exercise, a reaction force (or load) from the drive portion or pedals should be balanced against a force applied thereto by an exerciser. However, when the actuator is used as a load device, the control unit may adjust and limit a load torque generated by the actuator to the drive portion during the exerciser performs an exercise while moving the drive portion.

In such a case, as the response of the device is enhanced, the exerciser needs to have higher agility, but he or she is prevented for exerting an obviously dangerous force by restricting the limit of the load torque of the actuator in such a control operation. Consequently, the exerciser can be prevented from being endangered. In addition, safety can be ensured in a manner suitable for each of individual exercisers.

Preferably, the control unit may obtain a load in a rotation stopping mode and a low speed rotation mode of the;

actuator by supplying electric current to the actuator in the rotation stopping mode and the low speed rotation mode.

In such a case, in order to allow the actuator to serve as a load, there is no need for the actuator to function as a generator which generates electric power to be wastefully consumed though such wasteful power consumption is necessary in the conventional devices referred to above. Even when generation of sufficient electric power for a target load is unavailable, as in the case of the conventional devices, such a load can be generated by the actuator by supplying current thereto. Thus, an exerciser, such as an aged person, a patient or the like who can perform an exercise only at a low speed owing to his physical ability, can use the inventive exercise therapy device in an effective load control range. In addition, the inventive exercise therapy device makes it possible for healthy persons to exercise in a range of speeds, at which they have not achieved yet.

Preferably, the control unit may obtain a load higher than a rated load by supplying to the actuator a current higher than a rated current.

In such a case, with the conventional systems referred to above, an actuator or generator is required to generate electric energy so as provide a load and hence it is possible to obtain a rated load at most by means of the actuator. In contrast to this, according to the present invention, a higher load can be obtained by using the same actuator. Thus, a compact motor having a lower rated load can be used in the device of the present invention. Consequently, the size of the device can be reduced still more.

Preferably, a detector may be provided for detecting a position or an angle of a movable part of the drive portion which is moved by an exerciser when the exerciser causes a movement of the drive portion, so that the control unit can adjust an amount of a load that is put on the exerciser, based on information on the position or angle detected by the detector.

With this arrangement, as compared with the conventional device in which the load on the drive portion cannot be changed in dependence upon a position or rotational angle thereof within one revolution, the present invention enables a change in the load depending upon the position or rotational angle of the drive portion. Thus, a muscle used for rotating the drive portion (e.g., pedals) varies with the position (or rotational angle) of the drive portion. However, the load can be adjusted according to the muscle to be trained, by changing the load in dependence upon the position or rotational angle of the drive portion. Consequently, the effective training of muscles can be achieved. Additionally, even in the case of exercisers who cannot rotate the pedal in a certain region of rotational angles because of degradation in his or her physical strength due to, for instance, hemiplegia, the device of the present invention enables such exercisers to continuously perform an exercise by setting the load on the drive portion in such a manner that the load is changed from a value corresponding to the region of rotational angles, in which such an exerciser cannot rotate the pedal, to a value corresponding to a region of rotational angles, in which the exerciser can rotate the pedal.

Preferably, the control unit may back up a reference point of the position or rotational angle of the movable part of the drive portion upon interruption of a power supply when the exerciser performs an exercise while moving the drive portion.

With this arrangement, when the load is changed with the rotational angles, a reference point is inevitably established at some angle within one revolution. However, even when the power supply is turned off, the reference point determined the last time can be stored and reused. This eliminates the necessity of setting such a reference point again after the power supply is turned on. Consequently, this saves the trouble of setting an angular reference point each time the power supply is turned on. Additionally, repeatability is ensured by using the reference point established the last time once again.

Preferably, the direction of electric current flowing through the actuator may be reversed by the control unit. Thus, the actuator can be used in both cases of normal rotation and reverse rotation.

With this arrangement, a one-way clutch can be used in a reverse rotation mode. In contrast, with the aforementioned conventional devices, an assisting-force providing operation and a load providing operation are changed from one to the other by using a one-way clutch, and hence it is impossible to use the one-way clutch in the reverse rotation mode because the one-way clutch does not functions in this mode. However, with the device of the present invention, the one-way clutch can be used during a reverse rotating movement, in which muscles used for an exercise are different from those used during a forward rotating movement. Thus, during the reverse rotation, the inventive device makes it possible for an exerciser to train muscles different from those used in the forward rotation.

Preferably, in the case of performing a constant-watt load control operation, as the pedaling speed decreases, the load torque applied from the actuator to the drive portion should be increased. If such control operation is correctly performed, the required load torque increases with reduction in the rotational speed of the drive portion. As a result, the strength or force exerted by an exerciser becomes closer to the limit to the muscle strength thereof. Consequently, it becomes difficult for the exerciser to perform pedaling. However, the control unit may facilitate an exercise by limiting the load torque, which should be increased to a high value in a low speed region, to a low value when load control is performed at a constant watt. In such a case, the present invention is advantageous in that the exerciser easily does an exercise while moving the drive portion, e.g., performing pedaling.

Preferably, the control unit may adjust a load torque, which should be increased to a high value in a low speed region in correspondence with a physical ability of an individual exerciser, while taking into consideration of available physical strength thereof, so that the load torque is limited to a low value when load control is performed at a constant watt.

With this arrangement, differences in limit to the muscle strength among the individual exercisers can be eliminated. The setting of a load for facilitating the pedaling is achieved in correspondence with each of the individual exercisers. Thus, the setting of the load can be performed in such a manner as to be adapted to the level of the muscle strength of each of the individual exercisers. Consequently, the present invention can provide ease of pedaling-operation to various persons from healthy persons to physically infirm persons.

Preferably, the control unit may serve to adjust a speed and a load of the drive portion, and is able to adjust the load of the drive portion so that the speed, at which an exerciser moves the drive portion, is maintained at a predetermined speed even when the exerciser tries to move the drive portion at a speed that is higher than the predetermined speed.

With this arrangement, uniform exercise conditions can be specified by setting the rotational speed of the drive portion (e.g., the pedaling speed) in such a way as to have a constant value during an exercise. Thus, the exerciser is prevented from excessive exercise or motion (e.g., pedaling at an excessive speed). This makes it possible to prevent him or her from getting a strain in his or her leg and getting ill owing to an abrupt and strenuous exercise.

Moreover, to perform the load control operation, the output torque of the actuator should be controlled in such a way as to be changed according to a deviation between a target speed and a current speed. However, in the case where the response of the actuator can be only uniquely determined, the output torque is difficult to control. According to the present invention, however, the control unit may have a load control parameter, adjust and determine the response of the actuator in accordance with the load control parameter.

In this case, the response of the actuator and hence the device can be controlled and determined by this control parameter. Consequently, the response can easily be changed.

Preferably, in the case of an exercise performed by a person, the response is evaluated as the exerciser's feeling caused by pedaling. According to the present invention, the control unit may set the feeling caused by pedaling, which is the feeling of use of the exercise therapy device when an exerciser performs an exercise, by changing the load control parameter.

In this case, the response can be set in terms of the sensation of a person, instead of simple numerical values, representing the exerciser's feeling caused by pushing. Therefore, even a person, who cannot understand the meaning of numerical values, can change the setting of the device and can easily adjust the load.

Preferably, the control unit may set the load control parameter at different values in correspondence with individual exercises.

In such a case, the optimal value of the response evaluated as the feeling caused by pedaling, which vary with the physical ability and muscle strength of each exerciser, can be determined in correspondence with each of the individual exercisers. When the response is set at the ease-of-pedaling-operation for healthy persons, it is difficult for a physically infirm person to perform pedaling. Thus, the response can be set in accordance with the physical ability and muscle strength of each exerciser. Consequently, the present invention can provide an exercise therapy device by which even physically infirm persons can. easily perform pedaling.

Preferably, a speed detector may be further provided for detecting a speed of the movable part of the drive portion when the drive portion is moved by an exerciser. in this case, the control unit may have an overspeed protection function for preventing, based on detected-speed information from the speed detector, the movable part from being moved beyond a mechanical limit or an electrical limit.

With this arrangement, the pedaling is prevented from being performed at an excessive speed for the device during an exercise. Consequently, the device can be protected from being damaged due to the excessive speed.

Preferably, a current detector may be provided for detecting a current flowing through the actuator, and the control unit may have an overcurrent protection function of preventing, based on detected-current information from the current detector, an overcurrent that would otherwise cause burning of the control unit.

With this arrangement, an instantaneous overcurrent can be prevented from flowing through the device during an exercise. Consequently, the device can be protected from being damaged owing to the instantaneous overcurrent.

Preferably, a current detector may also be provided for detecting a current flowing through the actuator, and the control unit has an overload protection function of preventing, based on detected-current information from thee current detector, the actuator from burning owing to an excessive amount of heat.

Thus, the temperature of the device can be prevented from rising owing to a continuous overload during an exercise. Consequently, the device can be protected from being damaged owing to the overload.

Preferably, the control unit may set and adjust a feeling of use of the exercise therapy device, i.e., the exerciser's feeling caused by pedaling, by means of mechanical parameters which include a spring constant, a viscosity coefficient, and an inertia coefficient.

In this case, the response to be evaluated as the exerciser's feeling caused by pedaling can be determined and controlled by employing a mechanical model. Thus, the response can be evaluated as a parameter for use in a mechanical model. Consequently, the recognition of the physical meaning of the response is facilitated.

Preferably, the control unit may measure an equivalent mechanical parameter of a leg of an individual exerciser as a parameter including a spring constant, a viscosity coefficient, and an inertia coefficient.

In this case, an exerciser can be studied by employing a mechanical model. Further, the physical ability of an exerciser can be analyzed according to the mechanical model. This might enable analysis on the correlation among features of mechanical parameters caused by a disease.

BRIEF DESCRIPTION OF THE DRAWINGS

The above and other features, objects and advantages of the present invention will become apparent from the following description of preferred embodiments of the invention taken in conjunction with the accompanying drawings in which like reference characters designate like or corresponding parts throughout several views, and in which.

DESCRIPTION OF THE PREFERRED EMBODIMENTS

Hereinafter, the preferred embodiments of the present invention will be described in detail while referring to the accompanying drawings.

First Embodiment

Figure 1:
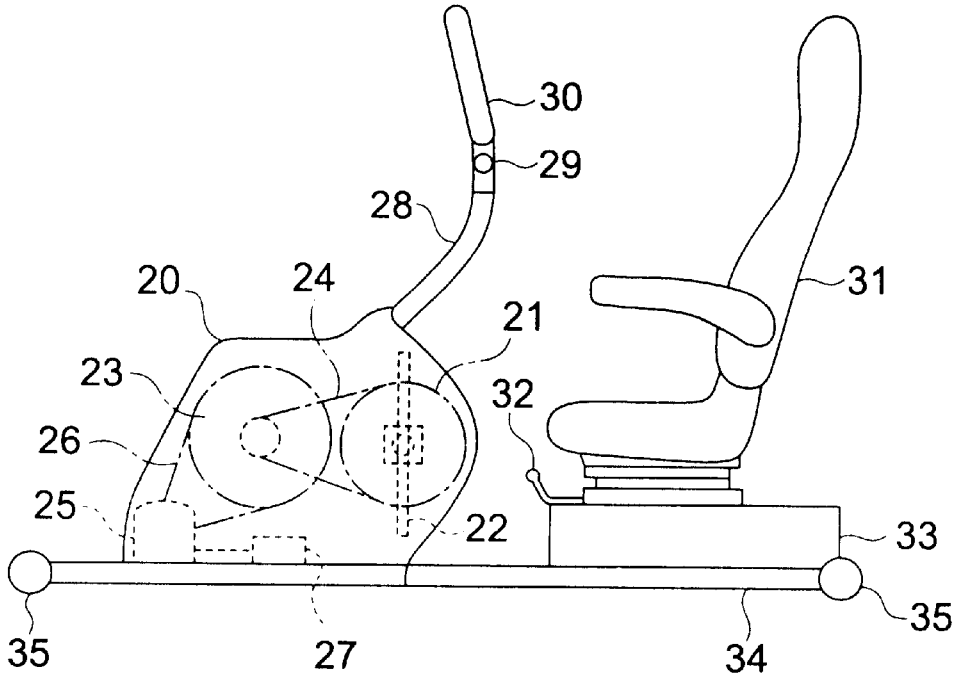
FIG. 1 is a side view of an exercise therapy device according to a first embodiment of the present invention.
Figure 2:
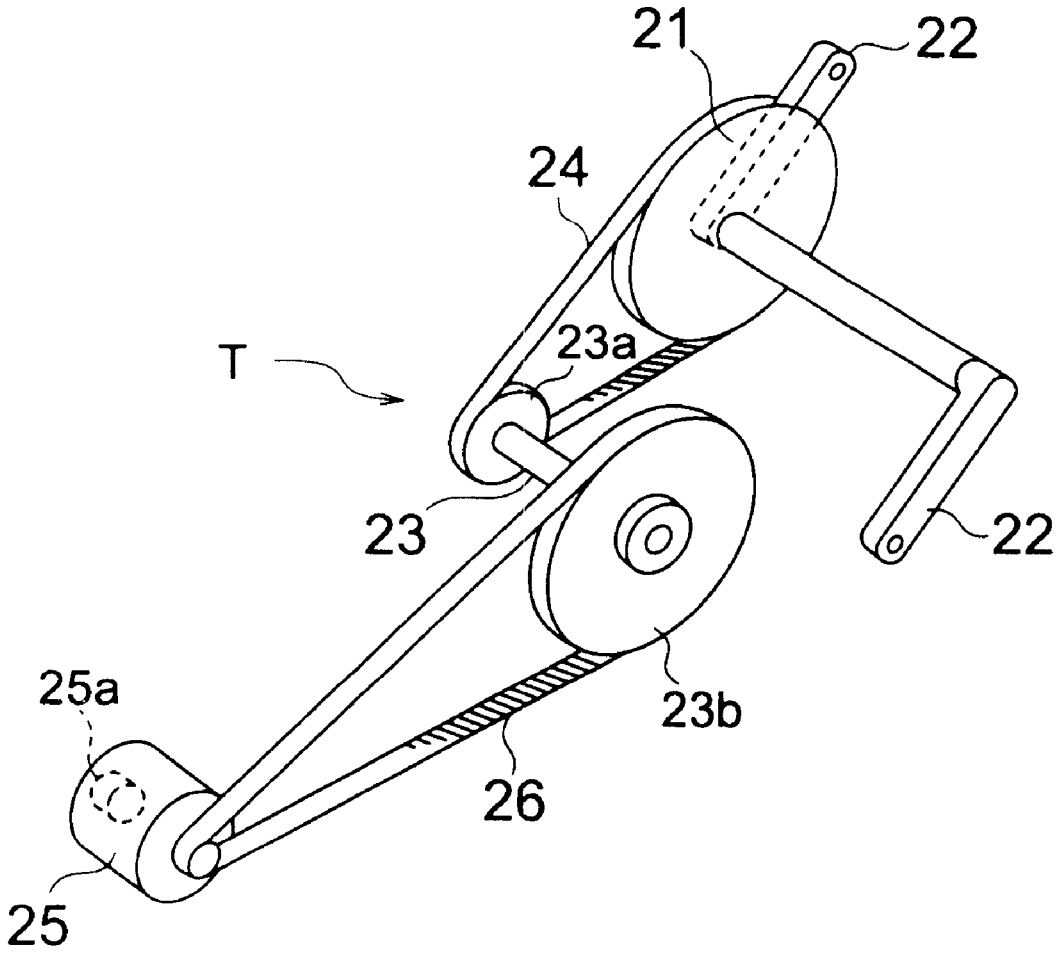
FIG. 2 is a perspective view of a primary part of the first embodiment of the present invention.

FIG. 1 schematically illustrates the construction of an exercise therapy device constructed in accordance with principles of the present invention, and FIG. 2 perspectively illustrates a primary portion of the exercise therapy device of the present invention.

In FIG. 1, the exercise therapy device of the present invention includes a main portion 20 which has an assist driving function of assisting a rotational motion of a exerciser in a range of the rotational speed of a pair of pedals 22, which is equal to or less than a predetermined value, a load reduction driving function of reducing a dynamic friction load of a mechanical system of the device in a low rotational speed range, and a load providing function of providing a load on the rotational motion of the exerciser when the exerciser rotates the pedals 22 in a high and a middle rotational speed range.

The main portion 20 of the exercise therapy device includes a pedal shaft pulley 21 having the pair of pedals 22 which are fixedly coupled thereto for integral rotation and serve as a drive portion, a servo motor 25 acting as an actuator, a power transmission mechanism T for transmitting a rotational force of the servo motor 25 to the pedal shaft, pulley 21, and a servo amplifier 27 serving as a control unit for controlling the servo motor 25.

The power transmission mechanism T comprises intermediate pulleys 23*a* and 23*b* respectively fixed to opposite ends of an intermediate shaft 23, a belt 24 looped between the intermediate pulley 23*a* and the pedal shaft pulley 21, and a belt 26 looped between the intermediate pulley 23*b* and the servo motor 25. The belts 24 and 26 of the power transmission mechanism T may be chains, like other force transmission member or mechanism. Further, the servo motor 25 contains a speed sensor 25*a* in the form of an encoder serving as a speed detecting portion for detecting the rotational speed of the servo motor.

A handle pole 28 is mounted on the main portion 20 of the exercise therapy device, and a handle 29 is mounted on the handle pole 28. A display/operation portion 30 is attached to the handle pole 28 at a location above the handle 29 with its display panel directed toward the exerciser. When a pedaling exercise is performed, an operator or exerciser can carry out various settings with respect to loads, the contents of control program files, motor-driving modes such as an assist driving mode, a zero. load driving mode, etc., through the display/operation portion 30.

A reclining chair 31 is disposed at a position to face the main portion 20, and it is slidably mounted on a chair base 33 so that it is moved toward and away from the main portion 20 and the display portion 30 through manipulation of an operation lever 32. The main portion 20 and the chair 31 with the chair base 33 are mounted as a unit on a rail base 34 which is provided at its longitudinal ends with wheels 35 for moving the exercise therapy device as a whole.

Further, the servo motor 25 is adapted to perform all the assisting drive function, the load reduction driving function, and the load providing function. When performing the assisting drive function or the load reduction driving function, the servo motor 25 generates counterclockwise torque. When performing the load providing function, the servo motor 25 generates clockwise torque.

Figure 3:
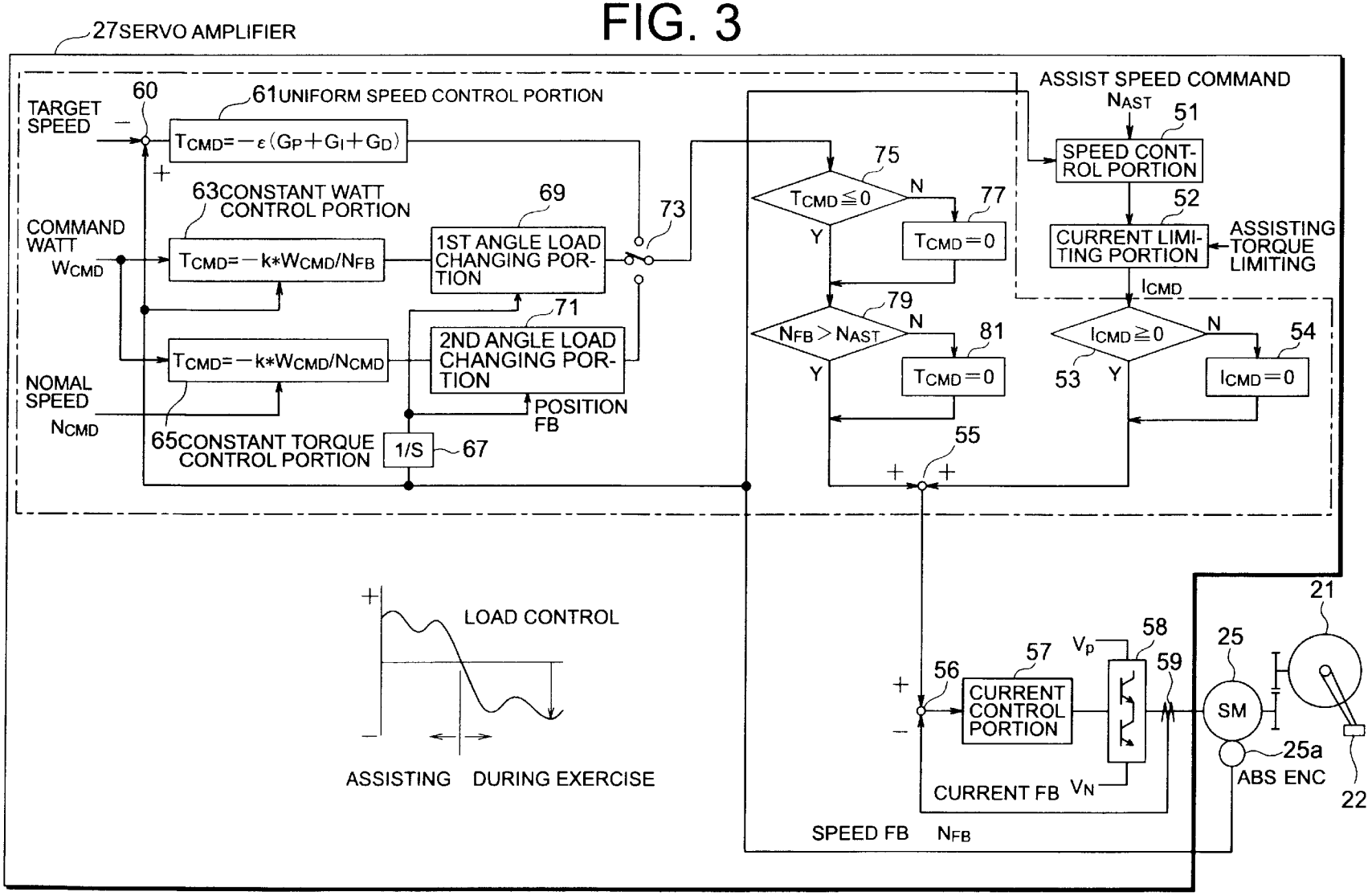
FIG. 3 is a block diagram illustrating a servo amplifier of the first embodiment of the present invention.

FIG. 3 is a block diagram illustrating the functional constitution of the servo amplifier 25 serving as a control unit for controlling the operation of the servo motor 25.

In FIG. 3, a functional block enclosed by a one-dot chain line represents a control function portion, which is a characteristic feature of the present invention and added to an ordinary servo control portion. Further, the positive and negative polarities of electric current are indicated such that the polarity of the current during an assisting drive operation is represented by a symbol "+" and that the polarity of the current during an exercise (i.e., under load) is represented by a symbol "−", as shown in a graph in FIG. 3.

Next, a control operation of the servo amplifier 27 serving as the control unit is described herein below by referring to FIG. 3. In the case where the servo amplifier 27 and the servo motor 25 are used in a speed operation mode that is an ordinary manner of use thereof, a speed command or instruction given by an operator or exerciser is controlled by a speed control portion 51 so that there is no difference between the value indicated by this command and the actual speed feedback value $N_{FB}$ of the servo motor 25. A designated value calculated by the speed control portion 51 is indicated by an electric current command supplied to the servo motor 25. The current limiting portion 52 imposes limitations on the electric current command so that electric current, which exceeds a maximum allowable current for the servo amplifier 27 and the servo motor 25, is prevented from being supplied thereto, thus protecting the amplifier 27 and the motor 25 from damage or failure. Further, according to the present invention, the current limiting portion 52 serves to put limitations on the electric current command in such a way as not to exert an excessive assisting force on a user of the exercise therapy device of the present invention. Incidentally, the torque at the time of an assisting operation can be adjusted in dependence on the user by using a criterion for putting limitations on a current command $I_{CMD}$ from the speed control portion 51 as a criterion for limiting torque corresponding to the user, instead of protecting the servo pump 27 and the servo motor 25.

The electric current command $I_{CMD}$ having got through a check in the current limiting portion 52 is compared with zero current in a current comparison portion 53. When $I_{CMD}<0$, the current command $I_{CMD}$ is controlled by a command current control portion 54 in such a manner as to have a value of 0. Conversely, when $I_{CMD}\geqq 0$ , the current command $I_{CMD}$ is sent to an addition portion 55, in which the value indicated by the current command $I_{CMD}$ is added to an output of a load control system (to be described later). Then, an output signal representing a result of the addition is sent to a subtraction portion 56.

In the subtraction portion 56, a feedback output of a current detecting portion 59 for detecting an output current of a transistor 58 (to be described later) for controlling the servo motor 25 is subtracted from the value indicated by the output signal of the addition portion 55. Then, an output signal representing a result of the subtraction is sent to a current control portion 57.

In the current control portion 57, a current control operation is performed according to the output signal of the subtraction portion 56 so that the difference between a value indicated by the output signal of the subtraction portion 56 and a current actual value (namely, a value of electric current to be fed back) of electric current supplied to the servo motor 25 becomes 0, similarly as in the case of the aforementioned electric current. According to a result of this control operation, the transistor 58 for controlling electric current supplied to the servo motor 25 is turned on or off. A power supply voltage Vp is applied from an external circuit to the transistor 58. When the transistor 58 is turned on, the servo motor 25 is driven by supplying the electric current thereto.

Incidentally, at that time, assuming that the direction of the electric current flowing through the servo motor 25 (namely, the direction indicated by the current command) during the acceleration of the speed from the stopping condition to the assisting speed is "+", the direction of the electric current during the deceleration of the speed; from a value, which is higher than the assisting speed, to the assisting speed is "−". When the servo motor 25 is reversed, the polarity is inverted. However, for the convenience of description, the control operation is described hereunder in the case of the normal rotation of the servo motor 25, which is employed as a reference case.

Now, even in the device of the present invention, an attempt is made to perform the assisting drive operation (namely, the assisting force drive operation) by performing only a control operation similar to that performed on an ordinary servo amplifier, the pedal 22 to be rotated and driven by the servo motor 25 is controlled in such a manner as to maintain the speed thereof at a value indicated by the speed command. Thus, an exerciser can neither quickly rotate the pedal 22 nor manually rotate the pedal 22 (namely, nor perform an exercise by taking on the load).

On the other hand, when the servo motor 25 is used as. the load, a reaction force can be obtained by reversing the electric current, as is understood from the foregoing description of the direction of the electric current. In this case, unless the aforementioned speed control (or assisting control) operation is performed, it is sufficient to input the load torque designated according to the load control mode (to be described later) as a value indicated by the current command by the servo amplifier 27.

Thus, to realize a control system that manages both the load control operation and the assisting control operation, portions for inputting the corresponding commands to the current control portion 57 are configured as illustrated in the block diagram of FIG. 3.

That is, when the actual speed feedback value $N_{FB}$ is equal to or less than the assisting command speed $N_{AST}$ ($N_{FB} \leqq N_{AST}$), the current command $I_{CMD}$ issued by the speed control portion 51 is inputted to the current control portion 57, and the load torque command value $T_{CMD}$ is canceled, because of the necessity for increasing the speed to the assisting command speed $N_{AST}$ without imposing a load on the foot of the exerciser.

Further, the current speed (namely, the actual speed feedback value) $N_{FB}$ of the servo motor 25 exceeds the assisting command speed $N_{AST}$ ($N_{FB} > N_{AST}$), the electric current command $I_{CMD}$ issued from the speed control system is canceled ($I_{CMD}=0$) in such a manner as to impose a load on the foot, of the exerciser and to prevent the speed from becoming lower than the assisting command speed $N_{AST}$ under the control of the speed control system. Moreover, the load torque command value $T_{CMD}$ is inputted to the current control portion 57.

Practically, in a state in which the current speed $N_{FB}$ is equal to or less than the assisting command speed $N_{AST}$ ($N_{FB} \leqq N_{AST}$), the polarity indicated by the electric current command $I_{CMD}$, which is outputted from the speed control portion 51, is "+". Thus, the electric current command $I_{CMD}$ is inputted to the current control portion 57. Conversely,. in a state in which the current speed $N_{FB}$ is more than the assisting command speed $N_{AST}$ ($N_{FB} > N_{AST}$) the polarity indicated by the electric current command $I_{CMD}$, which is outputted from the speed control portion 51, is "−". Thus, the value indicated this command is reduced to 0 ($I_{CMD}=0$) so as to prevent the electric current indicated by this command from entering the current control portion 57.

On the other hand, in the case of the load control system, in a state in which the current speed $N_{FB}$ is equal to or less than the assisting command speed $N_{AST}$ ($N_{FB} \leqq N_{AST}$), the load torque command value $T_{CMD}$ is changed into 0 so as to impose no load on the foot of the exerciser. Conversely, in a state in which the current speed $N_{FB}$ is more than the assisting command speed $N_{AST}$ ($N_{FB} > N_{AST}$), the load torque command value $T_{CMD}$ is outputted.

Incidentally, the load control operation is described hereinbelow. Generally, there are three kinds of load control modes, that is, a uniform speed control mode, a constant watt (momentum) control mode, and a constant torque control mode, as illustrated in FIG. 3.

In the uniform speed control mode, the target rotational speed of the pedal is maintained at a constant value regardless of the exerciser's manner of pedaling. In a state in which the rotational speed of the pedal is equal to or less than the target speed, the acceleration is facilitated by preventing the load from being imposed on the foot of the exerciser. Thus, the rotational speed is made to be nearly equal to the target speed.

There are several methods used in the uniform speed control mode. According to the present invention, the following method is employed. That is, first, the deviation $\epsilon$ between the target speed (or command speed) and the current speed of the pedal 22, namely, of the servo motor 25 is obtained by a subtraction portion 60. Then, in the uniform speed control portion 61, the deviation $\epsilon$ is multiplied by a control gain ($G_P+G_I+G_D$) so that the load is determined according to the deviation $\epsilon$. Thus, the load (or torque command value) is calculated. Incidentally, $G_P$ is a proportional gain. Further, $G_I$ is an integral gain. Moreover, $G_D$ is a differential gain. That is, the load torque command value $T_{CMD}$ is given by:

$$T_{CMD}=-\epsilon(G_p+G_I+G_D)$$

Figure 4A:
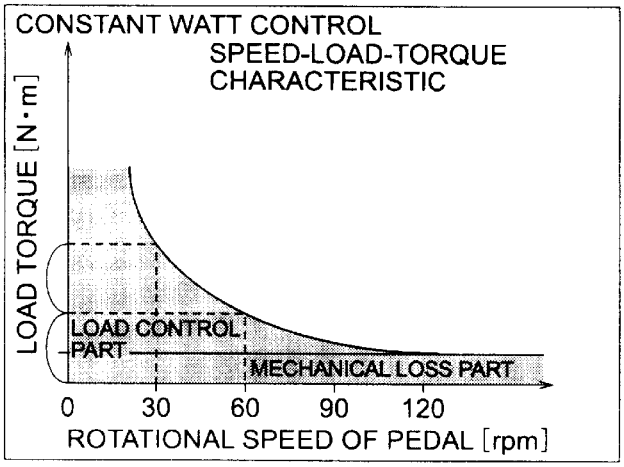
FIGS. 4A to 4C are graphs of a load torque control mode of the first embodiment of the present invention.
Figure 4B:
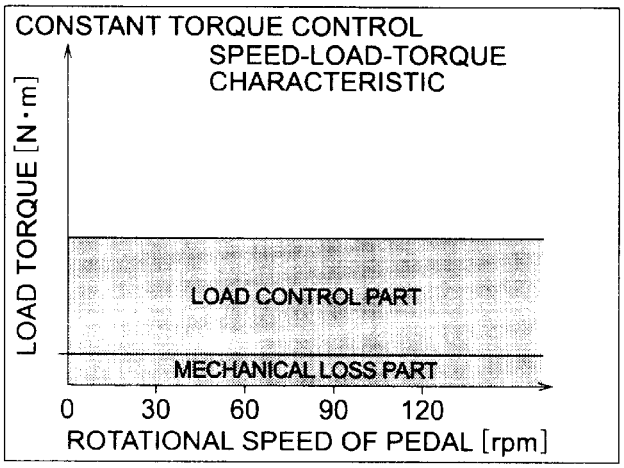
Figure 4C:
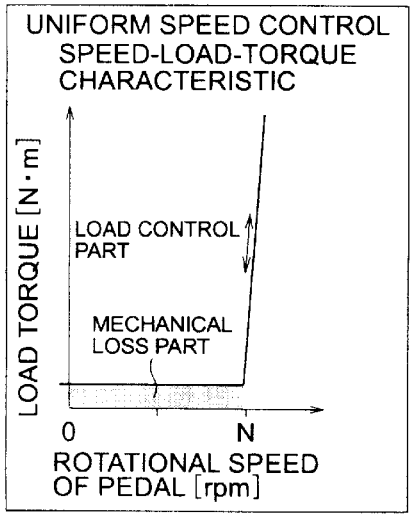

FIG. 4C illustrates an example of the relation between the load torque and the rotational speed of the pedal in this uniform speed control mode. As illustrated in this figure, when the rotational speed of the pedal is equal to or less than the predetermined speed N, the load torque is controlled in such a manner as to have a value that is approximately equal to a mechanic loss. Further, when the rotational speed of the pedal exceeds the predetermined speed N, the load torque abruptly increases.

In the constant watt control mode, the watt (or momentum) is made to be constant, irrespective of the speed at which the pedal 22 is rotated. The watt (or momentum) is physically obtained by the following equation:

Watt=Speed×Torque×Proportional Constant According to this equation, the constant watt control portion 63 performs a control operation of providing load torque in such a manner as to be in inverse proportion to the rotational speed of the pedal. That is, according to the aforementioned equation, the load torque command value $T_{CMD}$ is given by:

$$T_{CMD}=-k*W_{CMD}/N_{FB}$$

where (−k) is a proportional constant, and $W_{CMD}$ is a watt command value. FIG. 4A illustrates an example of the relation between the load torque and the rotational speed of the pedal in the constant watt control mode. In this example, the load torque decreases quadratically with increase in the rotational speed of the pedal. When the rotational speed of the pedal reaches 120 rpm, the load torque is reduced to the value equivalent to the mechanic loss.

In the constant torque control mode, it is sufficient that a command is provided to the current control portion of the servo amplifier 27 during the load torque is constant. To set the load torque in terms of watt (or momentum), the following method is employed. That is, a physical quantity, namely, a normal speed $N_{CMD}$ is established. Then, the load torque is calculated by dividing the watt command value $W_{CMD}$ by the normal speed $N_{CMD}$. That is, the load torque command value $T_{CMD}$ is given by:

$$T_{CMD}=-k*W_{CMD}/N_{CMD}$$

FIG. 4B illustrates the relation between the load torque and the rotational speed of the pedal in this case.

Further, in the load control system, the load corresponding to the pedal angle can be obtained by changing the load torque command value $T_{CMD}$ according to the pedal position data that is obtained by integrating the actual speed feedback value $N_{FB}$ of the servo motor 25.

Thus, the load torque command value $T_{CMD}$ obtained by the constant watt control portion 63 is changed and controlled by a first angle changing portion 69. Moreover, the load torque command value $T_{CMD}$ obtained by the constant torque control portion 65 is changed and controlled by a second angle changing portion 71. For example, at a pedal position, at which the pedal driving force of a user is maximized (namely, at a position at which the pedal is perpendicular to the legs when the legs are arranged in order), the load gain is set at 100%. Further, at a pedal position, at which the pedal driving force of a user is minimized (namely, at a position at which the angle formed between the pedal and the leg is 0 or 180 degrees when the legs are arranged in order), the load gain is set at 0. In the case that the position of the pedal is changed to the minimum driving force position from the maximum driving force position of the pedal, the load gain gradually decreases along, for instance, a cosine curve. Conversely, in the case that the position of the pedal is changed from the minimum driving force position to the maximum driving force position of the pedal, the load gain gradually increases along, for example, a cosine curve.

Then, the value $T_{CMD}$ is controlled and switched among the outputs of the uniform control portion 61, the first angle changing portion 69, and the second load changing portion 71 according to an operating mode. Thus, the value $T_{CMD}$ is outputted to a load torque comparison portion 75, whereupon it is decided whether the load torque command value $T_{CMD}$ is equal to or less than 0. When the load torque command value $T_{CMD}$ is more than 0 ($T_{CMD}>0$), the load torque command value $T_{CMD}$ is changed into 0 by a load torque control portion 77. Conversely, when the load torque command value $T_{CMD}$ is equal to or less than 0 ($T_{CMD}\leqq 0$), the load torque command value $T_{CMD}$ is outputted to a speed comparison portion 79. In the speed comparison portion 79, the speed feedback value $N_{FB}$ is compared with the assisting speed command value $N_{AST}$. When $N_{FB}\leqq N_{AST}$, the load torque command value $T_{CMD}$ is changed into 0 by a load torque control portion 81. Conversely, when $N_{FB}>N_{AST}$, the load torque command value $T_{CMD}$ is outputted to the addition portion 55.

In the addition portion 55, the load torque command value $T_{CMD}$, which is an output of the load control system, is added to the electric current command value $I_{CMD}$, which is an output of the assisting control system. A signal representing a result of this addition is outputted to the subtraction portion 56. In the subtraction portion 56, an output fed back from the transistor 58 (namely, electric current supplied to the servo motor 25) is subtracted from: the output ($T_{CMD}$+$I_{CMD}$) of the addition portion 55. A signal representing a result of this subtraction is outputted to the current control portion 57, which controls the current. supplied to the servo motor 25 by turning on and off the transistor 58 according to the output of the subtraction portion 56.

As is apparent from the foregoing description, according to the present invention, when the servo motor 25 is used as an assisting force device for an exercise, the assisting torque can be adjusted and limited by the current control portion 52. Thus, safety can be assured absolutely or in a manner suitable for each of the individual exercisers by adjusting the assisting torque correspondingly to the personal allowable level of each of the individual exercisers and restricting an obviously dangerous force. Further, when the assisting torque is adjusted to a rather low value, the device cannot operate unless the exerciser uses his strength to some extent. Thus, the exerciser cannot entirely depend on the machine. Consequently, this device can promote his exercise.

Moreover, when the servo motor 25 is used as an assisting force device for an exercise, the device can make an assisting force effective, based on a position or a range of angles, at which the mechanical friction of the device is more than the strength of an exerciser using the device, or at which the pedaling cannot be achieved by the physical ability of the exerciser. Thus, the device compensates for mechanical friction only in a range in which an exerciser cannot rotate the pedal, instead of the full range of one revolution of the pedal. Even in the case of an exerciser who cannot continuously perform pedaling because the entire region includes parts, in which the strength of the exerciser is less than the magnitude of mechanical friction, and in which degradation in his physical strength due to, for instance, hemiplegia, hampers the pedaling by the exerciser, the device enables him to continuously perform pedaling.

Furthermore, the device can obtain a load in a rotation stopping mode and a low speed rotation mode of the servo motor 25 by supplying electric current to the servo motor 25 in the rotation stopping mode and the low speed rotation mode. Thus, even when sufficient generated electric power for generating a load is unavailable similarly as in case of the conventional device, the load can be generated. Thus, exercisers, such as an aged person and a patient, who can perform an exercise only at a low speed owing to his physical ability, can use the exercise therapy device by an effective load control range. Additionally, this device enables an exercise in a range of speeds, at which even healthy persons have not achieved yet.

Besides, the device can obtain a load, which is higher than a rated load, by supplying a current, which is higher than a rated current, to the servo motor 25 through the use of the servo amplifier 27. Thus, as compared with the conventional system that depends upon the generated electric energy and can obtain the rated load at most by using an actuator, a higher load can be obtained by using the same actuator (namely, the servo motor 25) in this device of the present invention. Thus, the servo motor 25 having a low rated load can be used as the actuator in the device of the present invention. Consequently, the size of the entire device can be reduced still more.

Additionally, the exercise therapy device of the present invention may further comprise a detecting portion for detecting the position or angle of the pedal 22 serving as a movable part when an exerciser performs an exercise. Moreover, the device can adjust an amount of a load, which is put on the exerciser, by using the first and second load changing portions 69 and 71 according to information on the position or angle detected by the detecting portion. Thus, as compared with the conventional device in which the load cannot be changed according to the position within one revolution, the present invention enables such change in the load according thereto. Therefore, although a muscle used for rotating the pedal is varied with the positions (or angles) of the pedal 22, the load can be adjusted according to the muscle to be trained, by changing the load at each of the angles. Consequently, the effective training of muscles is achieved. Furthermore, even in the case of exercisers who cannot rotate the pedal in a certain region of the angles because of degradation in his physical strength due to, for instance, hemiplegia, the device of the present invention enables such exercisers to continuously perform an exercise by setting loads so that the load corresponding to the region of the angles, in which such an exerciser cannot rotate the pedal, differs in value from a load corresponding to a region of the angles, in which the exerciser can rotate the pedal.

Second Embodiment

Figure 5:
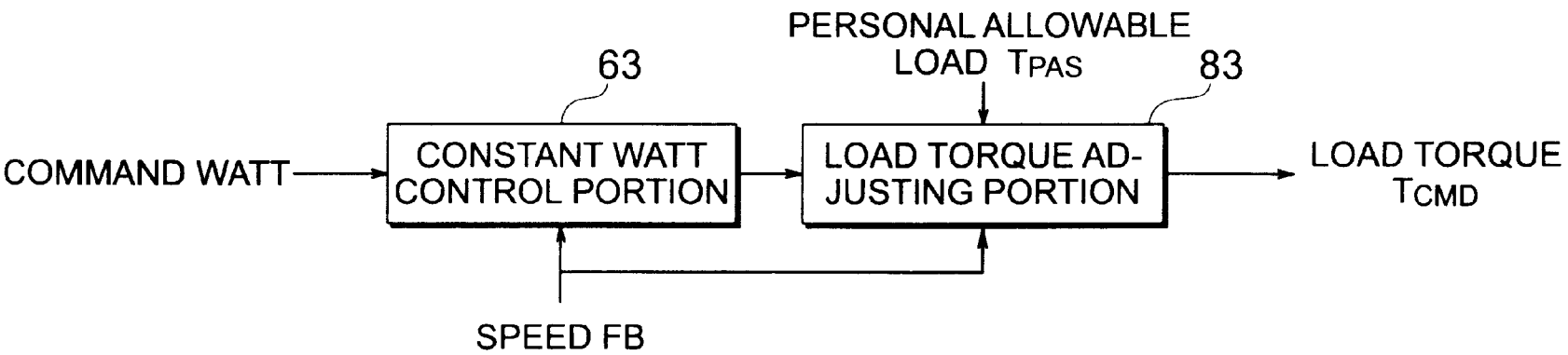
FIG. 5 is a block diagram illustrating a primary part of a servo amplifier according to a second embodiment of the present invention.

FIG. 5 illustrates an embodiment having a load torque adjusting portion 83 adapted to adjust the output of the constant watt control portion 63 according to the personal allowable load $T_{PAS}$ of each of the users. The load torque adjusting portion 83 is interposed between the constant control portion 63 and the first angle changing portion 69 of the first embodiment of FIG. 3, or between the first angle changing portion 69 and a switching portion 73 thereof. Moreover, the load torque adjusting portion 83 is operable to adjust an output of the constant watt control portion 63, or an output of the first angle changing portion 69. That: is, the load torque adjusting portion 83 is able to adjust and determine a load torque rate according to the current speed (namely, the actual speed feedback value $N_{FB}$) of the servo motor 25. An example of a method for this adjustment is as follows. That is, in the case of a first predetermined speed $N_{LOW}$, the load torque is set at 0. Thus, the load watt is set at 0. Consequently, an exerciser can easily start to pedal in the device that has been in a halt condition. Further, in the course of increasing the speed from the first predetermined speed $N_{LOW}$ to a second predetermined speed $N_{HIGH}$, while the load is imposed, the rate of an actually applied part of the force to originally be added is gradually increased.

Figure 6A:
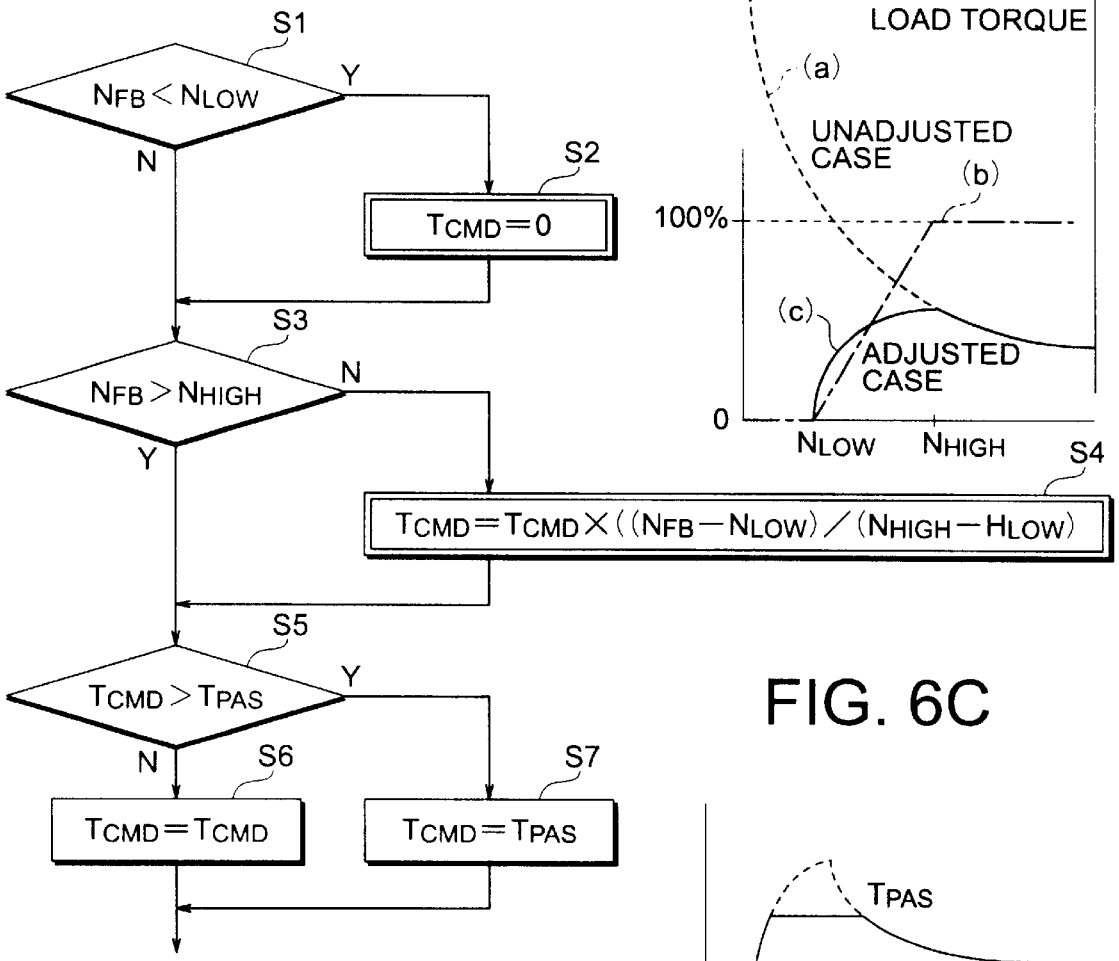
FIGS. 6A to 6C are a flowchart and diagrams, which illustrate an operation of the second embodiment of the present invention.
Figure 6B:
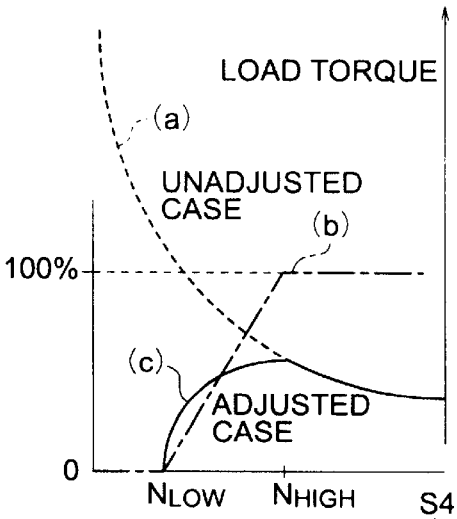
Figure 6C:
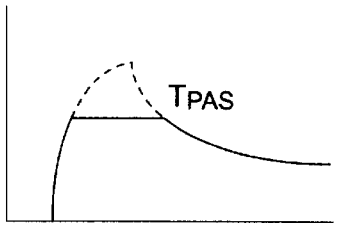

FIGS. 6A to 6C illustrate an operation of the load torque adjusting portion 83. FIG. 6A is a flowchart illustrating the steps of the operation of the load torque adjusting portion 83. FIG. 6B is a characteristic graph showing the relation between the rotational speed of the pedal and a load factor. In this graph, a dashed curve (a) indicates an output of the constant watt control portion 63. A one-dot chain line (b) indicates the load factor to be multiplied to the output $T_{CMD}$ of the constant watt control portion 63. A solid curve (c) represents an output of the: load torque adjusting portion 83. FIG. 6C is a characteristic graph illustrating a state in which the load torque is adjusted in such a manner as not to exceed the personal allowable load $T_{PAS}$.

Next, an operation of this load torque adjusting portion 83 is described hereinafter with reference to FIGS. 6A to 6C.

First, it is judged in step S1 whether or not the current speed (namely, the actual speed feedback value $N_{FB}$) of the servo motor 25 is lower than the first predetermined rotational speed $N_{LOW}$. If "YES", the output $T_{CMD}$ of the constant watt control portion 63 is set at 0 by being multiplied by the load factor "0". Then, in step S2, a resultant value ($T_{CMD}$=0) is outputted. Conversely, if "NO", subsequently, it is judged in step S4 whether or not the value $N_{FB}$ is higher than the second predetermined rotational speed $T_{HIGH}$ that is higher than the first predetermined rotational speed $N_{LOW}$. If "NO", the output $T_{CMD}$ is adjusted according to the following equation:

$$T_{CMD}=T_{CMD}\times(N_{FB}-N_{LOW})/(N_{HIGH}-N_{LOW})$$

where this ratio $(N_{FB}-N_{LOW})/(N_{HIGH}-N_{LOW})$ is the load factor. For example, as indicated by the one-dot chain line (b) in FIG. 6B, the load factor is 0 in the range between 0 and $N_{LOW}$. Further, in a range between $N_{LOW}$ and $N_{HIGH}$, the load factor increases at a constant gradient. In the case that the rotational speed is higher than $N_{HIGH}$, the load factor is set at 100%. Consequently, the output $T_{CMD}$ adjusted by being multiplied by the load factor changes along the solid curve (c) illustrated in FIG. 6B.

If "YES" in step S3, control skips step S4 and advances to step S5, whereupon it is judged whether or not $T_{CMD}$ is higher than $T_{PAS}$ ($T_{CMD}>T_{PAS}$) . As illustrated in FIG. 6C, if "NO", the current $T_{CMD}$ is outputted in step S6. Conversely, if "YES", the output $T_{CMD}$ is reduced to $T_{PAS}$($T_{CMD}=T_{PAS}$) and outputted in step S7.

Further, when the servo motor 25 is used as a load device, the load torque adjusting portion 83 can adjust and limit the-speed of the drive portion during an exercise. Thus, an exerciser can be prevented from performing pedaling at an excessive speed when performing an exercise. Therefore, the exerciser does not pedal at an excessive speed. This prevents him from getting a strain in his legs and getting ill owing to an abrupt and strenuous exercise.

Further, when the servo motor 25 is used as an exercise assisting force device, the device can adjust and limit the speed of the drive portion during an exercise. Thus, safety can be ensured in absolutely or in a manner suitable for each of the individual exercisers by setting a speed having correlation to the speed, at which an exercise is performed, and preventing this speed from increasing to an obviously dangerous value. Moreover, in the case that the speed generated owing to the assisting torque is set in such a manner as to be lower than the pedaling speed to be employed at the exercise, the assisting force can be made to be effective only in a part, in which an exerciser does not perform pedaling because of fatigue or degradation in his strength, of the entire range. Conversely, in a part, in which the exerciser can perform the exercise by himself, he is adapted to perform the exercise by using his strength.

Meanwhile, to obtain a constant pedaling speed during an exercise, a reaction force (o load) from the pedal should be balanced against the force applied thereto. However, according to the present invention, when the servo motor 25 is used as the load device, the load torque adjusting portion 83 can adjust and limit the load torque during an exercise. Thus, the generation of an obviously dangerous force is prevented by restricting the limit to such a force in this control operation.

Consequently, the exerciser can be prevented from being endangered. Additionally, safety can be ensured in a manner suitable for each of individual exercisers.

In the foregoing description of this embodiment, it has been described that the load torque adjusting portion 83 is interposed between the constant watt control portion 63 and the first angle changing portion 69. However, the load torque adjusting portion 83 may be interposed between the first angle changing portion 69 and the switching portion 73. In this case, the load torque adjusting portion 83 acts upon outputs of the first angle changing portion 69, almost similarly as described above.

Third Embodiment

Figure 7:
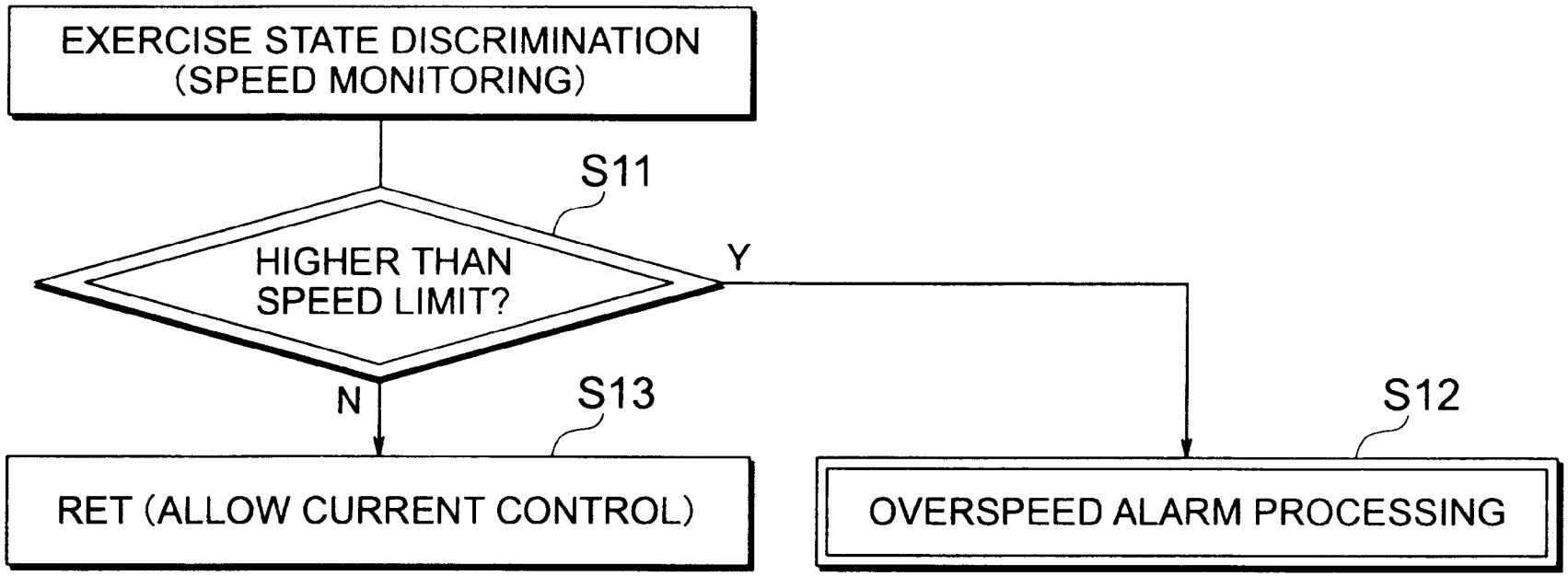
FIG. 7 is a flowchart illustrating an operation of a third embodiment of the present invention.

FIG. 7 is a flowchart illustrating an operation of an exercise therapy device that is a third embodiment of thee present invention. In the third embodiment, the servo amplifier 27 is able to perform an operation, which does not relates directly to the load control, of judging a current exercise state and issuing an alarm to a user at an occurrence of an abnormal speed (or overspeed), in addition to the operations described in the foregoing description of the first embodiment. Practically, as illustrated in the flowchart of FIG. 7, it is judged in step S11 whether or not the rotational speed of the pedal is higher than a predetermined speed limit. If "YES", control performs an overspeed alarm operation of warning a user of the "overspeed" in step S12. Conversely, if "NO", the current control situation is allowed without issuing an alarm in step S13. Methods of performing the overspeed alarm operation are as follows. For instance, a message indicating an overspeed alarm is displayed for an exerciser, so that the pedaling speed is reduced under the manual control of the exercise. Alternatively, during the overspeed state, the load is gradually increased. Such an increase in the load prevents an exerciser from pedaling at a high speed.

Alternatively, the overspeed alarm operation may be performed by employing a method of adjusting the load in such a way as to maintain the pedaling speed at a predetermined speed even when an exerciser tries to perform an exercise at a speed, which is higher than the predetermined speed.

Fourth Embodiment

Figure 8:
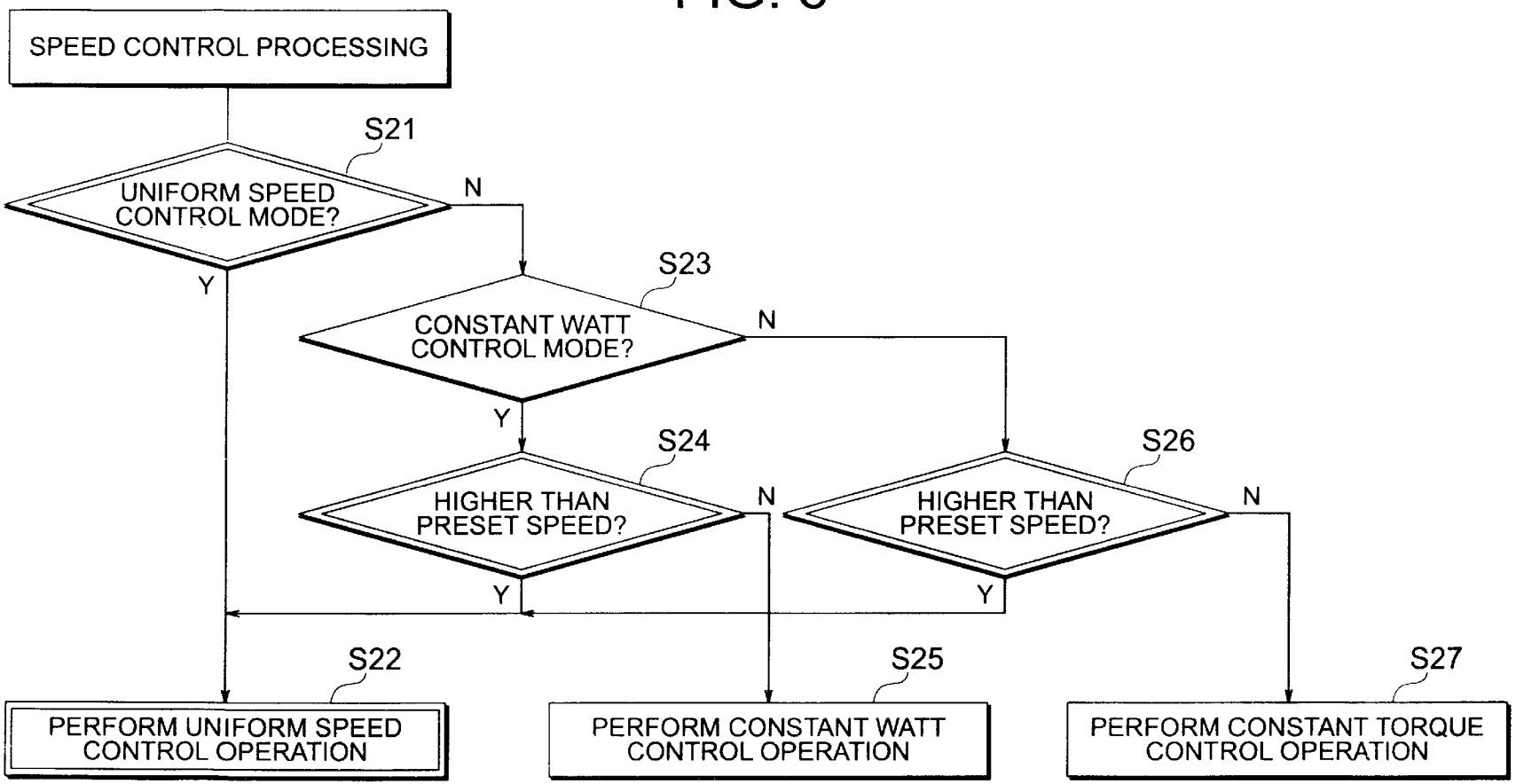
FIG. 8 is a flowchart illustrating an operation of a fourth embodiment of the present invention.

FIG. 8 is a flowchart illustrating an operation of an exercise therapy device that is a fourth embodiment of the present invention. The fourth embodiment has a function of basically changing an exercise mode to the uniform speed control mode in the case that overspeed occurs in an exercise mode other than the uniform speed control mode. The control modes may be changed by causing the switching portion 73 of the first embodiment to perform this function.

Practically, as illustrated in the flowchart of FIG. 8, it is first judged from input data (on a target speed, a command watt, and a normal speed) to the servo amplifier 27 in step S21 whether or not the current exercise mode is the uniform speed control mode. In the case that there is input data on the target speed (namely, if "YES"), the operation to be performed in the uniform speed control mode is performed. Conversely, in the case that there is no input data on the target speed (namely, if "NO"), it is, subsequently, judged in step S23 from the input data (on the target speed, the command watt, and the normal speed) to the servo amplifier 27 whether or not the current exercise mode is the constant watt control mode. In the case that there; is input data on the command watt (namely, if "YES"), it is next judged in step S24 whether or not the current speed is higher than the preset speed. If "YES", the operation to be performed in the uniform speed control mode is performed in step S22. Conversely, if "NO", the operation to be performed in the constant watt control mode is performed in step S25. Further, if it is found in step S23 that there is no command watt (if "NO"), it is then judged in step S26 whether or not the current speed of the servo motor 25 is higher than the preset speed. If "YES", the operation to be performed in the uniform speed control mode is performed in step S22. Conversely, if "NO", the operation to be performed in the constant torque control mode is performed in step S27.

Incidentally, the operation to be performed in the constant watt control mode, and the operation to be performed in the constant torque control mode are performed in step S25 and S27, respectively, by way of example. In the case of employing other control modes, operations to be performed in such control modes may be performed in these steps.

Fifth Embodiment

Figure 9:
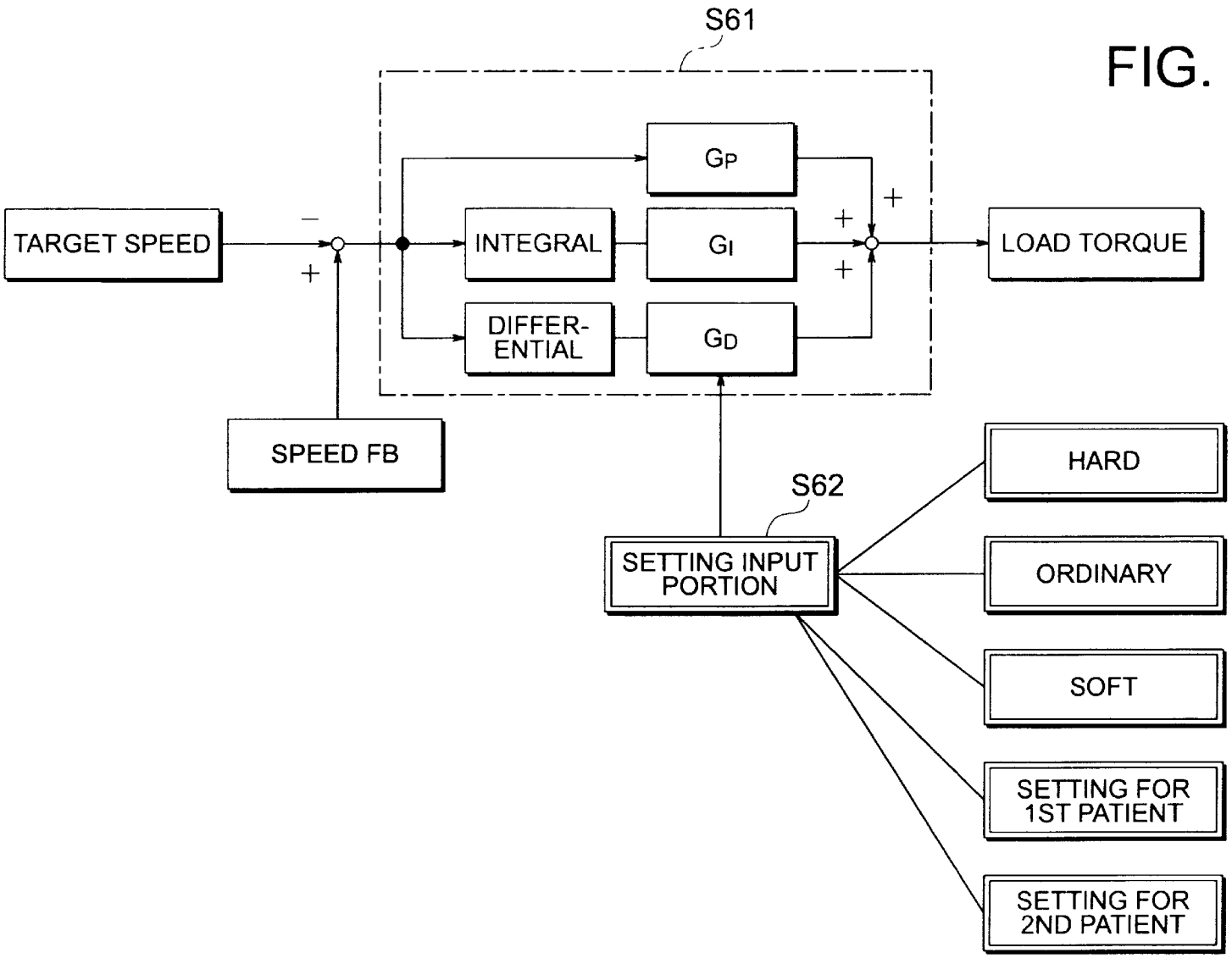
FIG. 9 is a flowchart illustrating an operation of a fifth embodiment of the present invention.

FIG. 9 is a block diagram illustrating an operation of an exercise therapy device that is a fifth embodiment of the present invention. This fifth embodiment has a setting input portion for adjusting control parameters (namely, the proportional gain $G_P$, the integral gain $G_I$ and the differential gain $G_D$) used in the uniform speed control portion 61 of the servo amplifier 27 of the first embodiment illustrated in FIG. 3. The control parameters used in the uniform speed control portion 61 can be changed and controlled by performing an input operation in the setting; input portion 62. Consequently, the response of the device can be adjusted by controlling the load torque.

That is, as illustrated in FIG. 9, the uniform speed control portion 61 is operative to multiply the deviation $\epsilon$, between the target speed and the current speed (namely, the actual speed feedback value $N_{FB}$) of the servo motor 25 by the proportional gain $G_P$, and to multiply a value, which is obtained by integrating (or accumulating) the deviations $\epsilon$, by the integral gain $G_I$, and to multiply a value, which is obtained by differentiation of the deviations $\epsilon$, by the differential gain $G_D$, and to then adds up results of such multiplications and output a resultant value as a load torque value. Thereafter, a "hard" command, an "ordinary"command, and a "soft" command are inputted to the setting input portion 62 by using input means, such as a keyboard or a mouse. Thus, the proportional gain $G_P$, the integral gain $G_I$ and the differential gain $G_D$ are changed, and the load torque is adjusted. Consequently, the response of the device can be adjusted. For instance, these gains are increased by inputting the "hard" command. Then, the load torque is abruptly changed. Consequently, the response of the device is enhanced. Alternatively, these gains are decreased by inputting the "soft" command. Then, the load torque is slowly changed. Consequently, the response of the device is slowly changed.

Moreover, such an operation of the setting input portion 62 may be performed by preparing a table indicating the corresponding relation between the input command selected from the "hard", "ordinary" and "soft" commands and a change in each of the proportional gain $G_P$, the integral gain $G_I$, and the differential gain $G_D$, which is caused by the input command, or producing and storing a pattern indicating the corresponding relation therebetween.

Furthermore, the alteration of such control parameters may be performed by preliminarily setting control commands, corresponding to users, such as patients, and inputting the set control commands, such as a "1st SETTING FOR PATIENT" command and a "2nd SETTING FOR PATIENT" command by use of the input means, such as an operating button, a keyboard, and a mouse.

Sixth Embodiment

Figure 10:
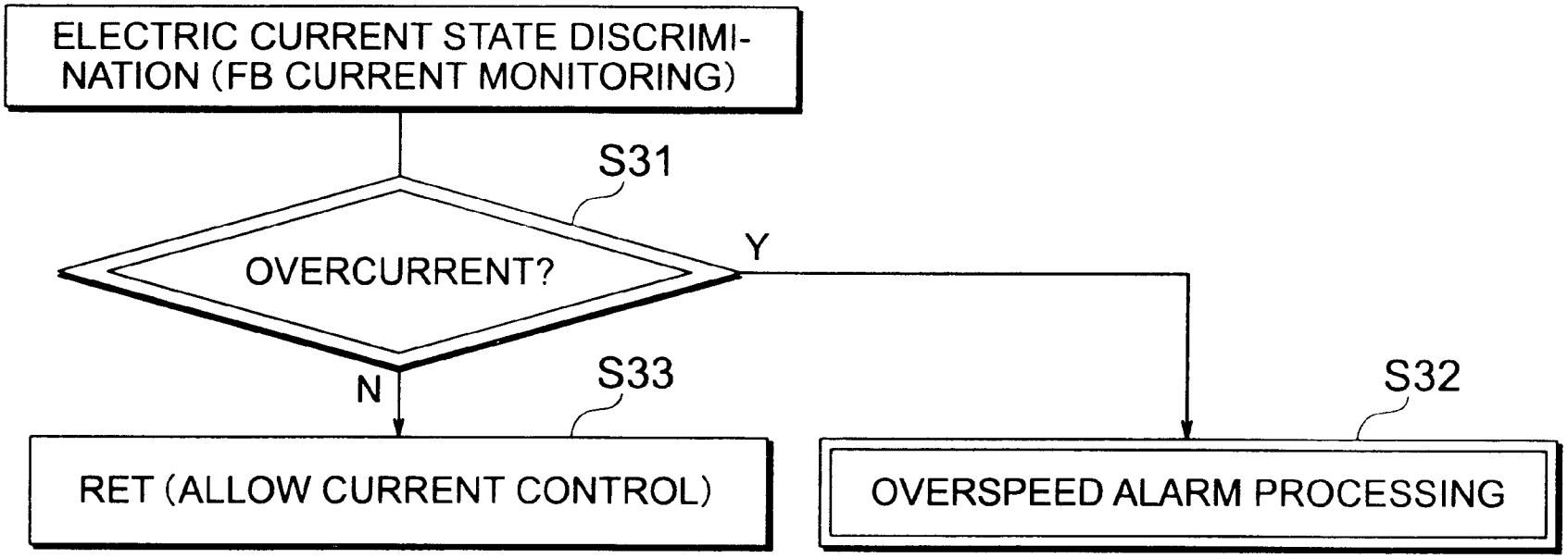
FIG. 10 is a flowchart illustrating an operation of a sixth embodiment of the present invention.

FIG. 10 is a flowchart illustrating an operation of an exercise therapy device that is a sixth embodiment of the present invention. In the sixth embodiment, the servo amplifier 27 is able to perform an operation, which does not relates directly to the load control, of judging the current state of electric current and alerting a user at an occurrence of an abnormal current (or overcurrent), in addition to the operations described in the foregoing description of the first embodiment. Practically, as illustrated in the flowchart of FIG. 10, it is judged in step S31 whether or not the electric current supplied to the servo motor 25 (namely, the output of the transistor 58) is more than a predetermined electric current limit. If "YES", control performs an overspeed alarm operation of warning a user of the "overcurrent" in step S32. Conversely, if "NO", the current control situation is allowed without issuing an alarm in step S33.

A practical example of the overcurrent alarm operation is performed as follows. In the case that the current supplied to the servo motor 25 (namely, the output of the transistor 58) is more than the predetermined current limit, the operation of the servo motor 25 is controlled by reducing the electric current supplied to the transistor 58 or turning off the transistor 58 by means of, for instanced the current limiting portion 57 (see FIG. 3).

Figure 11:
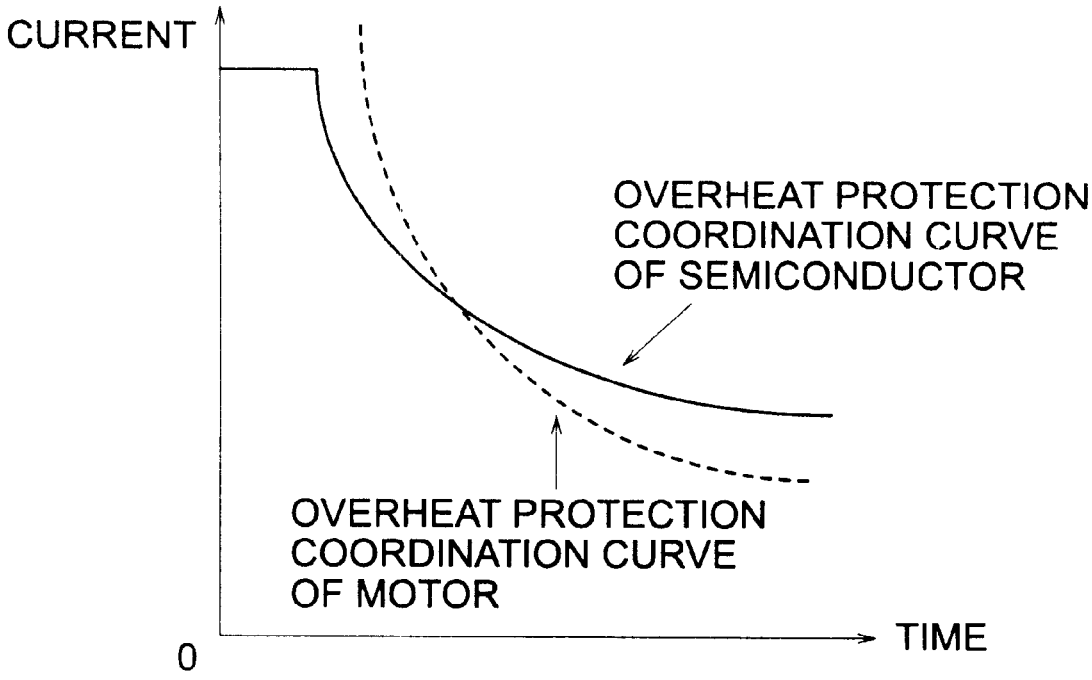
FIG. 11 is a graph illustrating a heat-resisting characteristic of a semiconductor electronic part and a servo motor.

FIG. 11 is a graph illustrating the heat-resisting characteristic of the semiconductor electronic parts, such as the transistor 58, and the servo motor 25. This graph illustrates the relation between electric current and time in the neighborhood of the heat resistance limit. In this graph, a solid curve (namely, an overheat protection coordination curve) represents the heat-resisting characteristic of the semiconductor electronic part. Further, a dashed curve (namely, an overheat protection coordination curve) represents the heat-resisting characteristic of the servo motor 25. As is apparent from this graph, when an instantaneous overcurrent flows therethrough, the servo motor 25 is superior to the semiconductor electronic part in heat resistance. Conversely, when the temperature rises owing to continuous overload (namely, the electric current continuously flow therethrough for a long time), the semiconductor electronic part is superior to the servo motor 25 in heat resistance.

Therefore, the instantaneous overcurrent is prevented by controlling the electric current, which is supplied to the servo motor 25, in consideration of such a heat-resisting characteristic from flowing through the device during an exercise. Thus, the semiconductor electronic part can be prevented from being burnt and damaged owing to the instantaneous overcurrent. Alternatively, the temperature. of the device is prevented from rising due to the continuously excessive load (namely, overload) during an exercise. Consequently, the servo motor 25 can be prevented from being burnt and damaged owing to the overload.

Seventh Embodiment

Figure 12:
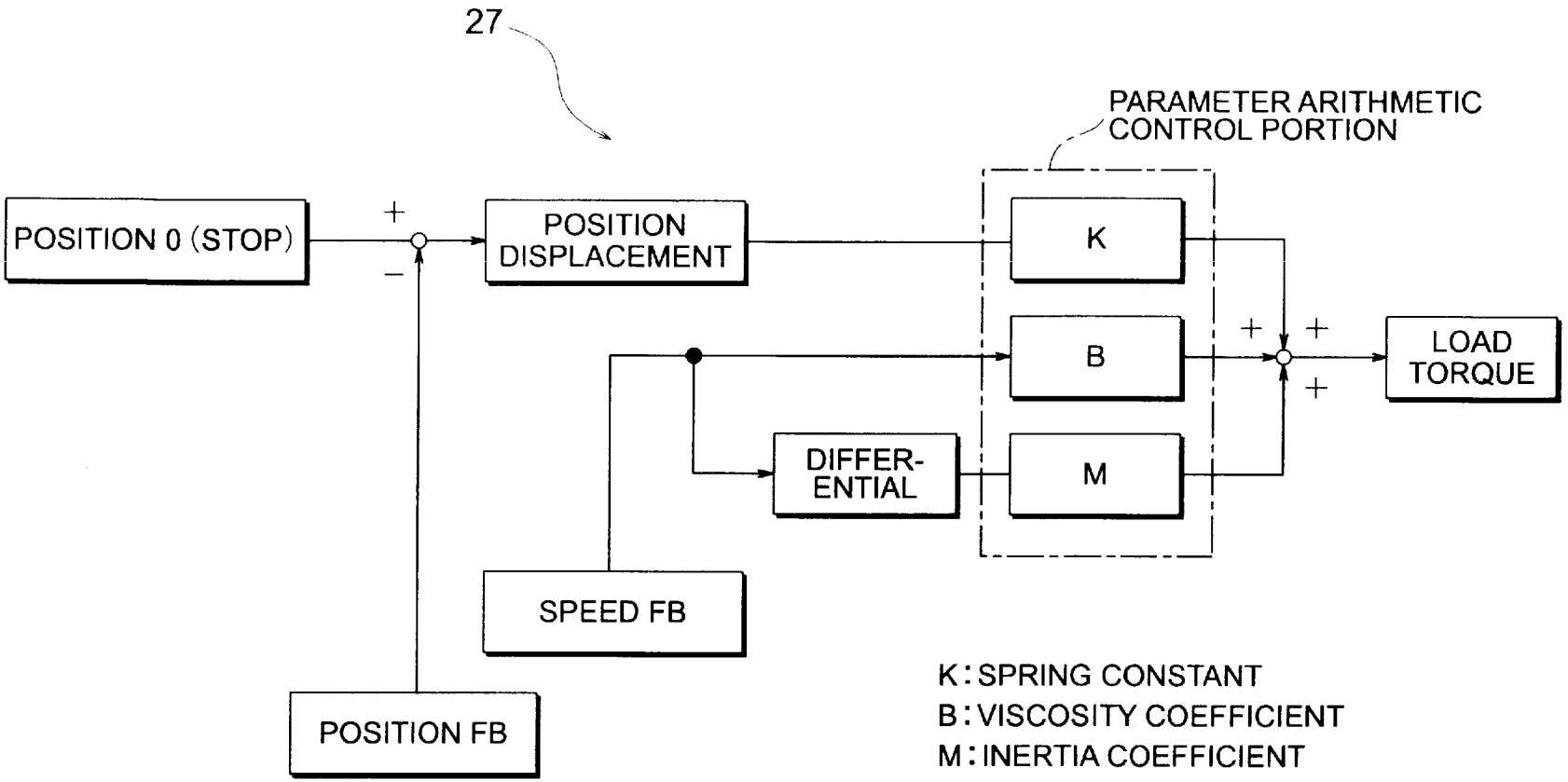
FIG. 12 is a flowchart illustrating an operation of a seventh embodiment of the present invention.

FIG. 12 is a block diagram illustrating an operation of an exercise therapy device that is a seventh embodiment of the present invention. In the case of the seventh embodiment, the exerciser's feeling caused by using the device is set and adjusted by employing mechanical parameters that include a spring constant, a viscosity coefficient, and an inertia coefficient. That is, the load torque is evaluated by being decomposed into a spring force, a viscous force and an inertial force, and represented as a resultant of these forces. Consequently, the load torque can be set and adjusted by employing the mechanical parameters including a spring constant K, a viscosity coefficient B, and an inertia coefficient M.

As illustrated in FIG. 12, the servo amplifier 27 has a parameter arithmetic control portion capable of detecting a positional displacement from the difference between the reference position (namely, the stopping position$_{FB}$) and the current position (namely, the position FB) obtained by integrating outputs of a speed sensor (namely, the actual speed feedback value $N_{FB}$ of the servo motor 25), and then multiplying the positional displacement with the spring constant K, and multiplying the output of the speed sensor (namely, the speed FB) by the viscosity coefficient B, and moreover, multiplying the value obtained by performing differentiation on the output of the speed sensor (namely, the speed FB) by the inertia coefficient M, and adding up results of such operations, and finally outputting a result of this addition as a value of the load torque.

Thus, the parameter arithmetic control portion is operative to calculate the load torque according to the deviation of the current position from the reference position, and is able to adjust the output load torque by changing the parameters K, B, and M. Consequently, this embodiment can adjust the exerciser's feeling of use of the exercise therapy device.

Eighth Embodiment

Figure 13:
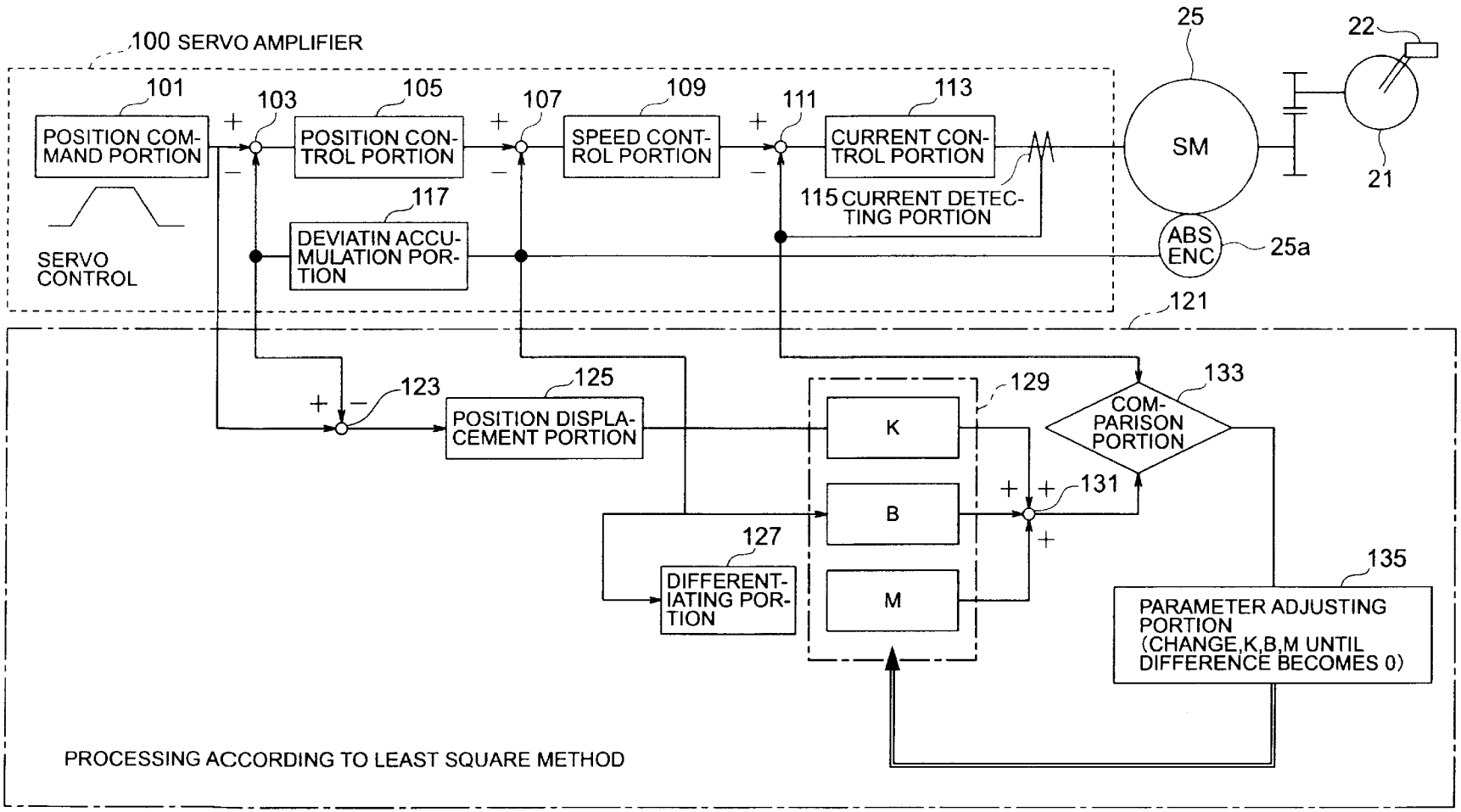
FIG. 13 is a flowchart illustrating an operation of an eighth embodiment of the present invention.
Figure 14:
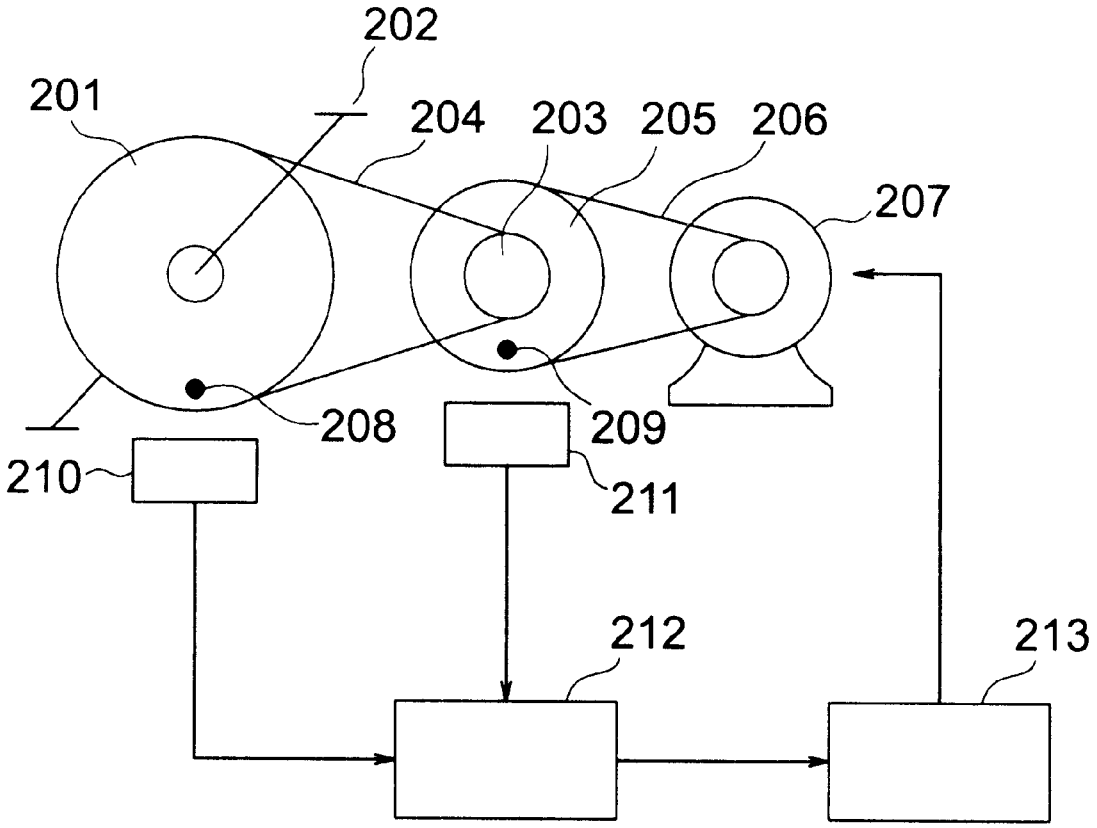
FIG. 14 PRIOR ART
FIG. 14 is a diagram schematically illustrating the construction of a conventional exercise therapy device.

FIG. 13 is a block diagram illustrating the configuration of an exercise therapy device that is an eighth embodiment of the present invention. The eighth embodiment includes the parameter arithmetic control portion of the aforementioned seventh embodiment and is thus able to measure an equivalent mechanical parameter of the leg of each of the individual exercisers as a parameter including the spring constant K, the viscosity coefficient B, and the inertia coefficient M.

In FIG. 13, reference characters 21 to 27 designate similar constituent elements of the first embodiment. The control unit of the eighth embodiment has a servo amplifier 100 for controlling an operation of the servo motor 25, and also has a parameter measurement portion 121.

The servo amplifier 100 includes a position command portion 101 to which a position command is inputted from an external circuit, a subtraction portion 103 for obtaining the deviation between an output of the position command portion 101 and an output of a deviation accumulating portion 117 (to be described later), a position control portion 105 for controlling the position of the servo motor 25 according to an output of the subtracting portion 103, a subtracting portion 107 for obtaining the deviation between an output of the position control portion 105 and an output of a speed sensor 25*a*, a speed control portion 109 for outputting an electric current value to be used to control the speed of the servo motor 25 according to an output of the subtracting portion 107, a subtracting portion 111 for obtaining the deviation between an output of the speed control portion 109 and an output of an electric current detecting portion 115 (to be described later), an electric current control portion 113 for controlling electric current supplied to the servo motor 25 according to an output of the subtracting portion 111, an electric current detecting portion 115 for detecting electric current supplied to the servo motor 25 from the current control portion 113, and a deviation accumulation portion 117 for obtaining the rotation position of the servo motor 25 by integrating (or accumulating) outputs of the speed sensor 25*a*.

Further, the parameter measurement portion 121 includes a subtraction portion 123 for obtaining the deviation between an output of the position command portion 101 and an output of the deviation accumulation portion 117, a position displacement portion 125 for obtaining a positional displacement amount of the servo motor 25 according to an output of the subtracting portion 123, a differentiating portion 127 for differentiating an output of the speed sensor 25*a*, a gain multiplication portion 129 for multiplying an output of the position displacement portion 125, for multiplying an output of the speed sensor 25*a* by the viscosity coefficient B, and for multiplying an output of the differentiating portion 127 by the inertia coefficient M, an addition portion 131 for adding up output of the gain multiplication portion 129, a comparison portion 133 for comparing an output of the addition portion 131 with an output of the speed sensor 25*a*, and for outputting the deviation therebetween, and a gain adjusting portion 135 for changing and adjusting the parameters (the gains K, B, and M) until an output of the comparison portion 133 becomes 0.

The servo amplifier 100 is controlled as an ordinary position loop control servo amplifier, and operated by a position variation command according to a fixed pattern provided to the position command portion 101. The servo amplifier 100 measures and stores feedback data on the position and speed of, and the electric current supplied to the servo motor 25 at that time, and calculates the values of the parameters K, B, and M, according to which the value of the electric current fed back as a result of an exercise is matched with an output thereof, which is obtained by changing the values of the parameters K, B, and M, as much as possible, by using, for example, a least square method.

Incidentally, in the foregoing description of the eighth embodiment, the description of the load control system is omitted, because of no need for controlling the load torque. However, a load control system, which is similar to that of the first embodiment illustrated in FIG. 3, may be added to the servo amplifier 100. This enables the control of the load torque. Moreover, when the servo amplifier 100 and the parameter measurement portion 121 are operated by setting control input data to the load control. system to be zero (0), the device can measure the equivalent mechanical parameter of the leg of the individual exerciser as each of the parameters respectively corresponding to the spring constant K, the viscosity coefficient B, and the inertia coefficient M.

Although the preferred embodiments of the present invention have been described above, it should be understood that the present invention is not limited thereto and that other modifications will be apparent to those skilled in the art without departing from the sprint of the invention.

The scope of the present invention, therefore, should be determined solely by the appended claims.

What is claimed is:

1. An exercise therapy device comprising:

a drive portion manually moved by an exercising person;

a power transmission mechanism;

a single actuator operably linked to said drive portion through said power transmission mechanism; and a control unit for controlling said single actuator to operate alternatively as a, load device providing a load to said drive portion for resisting a force applied by the exercising person in manually moving said drive portion and as an assisting device providing an assisting force to said drive portion assisting a force applied by the exercising person in manually moving said drive portion, said control unit controlling said actuator to provide the assisting force in a range of positions and. rotational angles of said drive portion, determined by said control unit, at which mechanical friction of said drive portion exceeds force that can be manually applied to said drive portion by the exercising person.

2. The exercise therapy device according to claim 1, wherein said control unit adjusts and limits the assisting force.

3. The exercise therapy device according to claim 1, wherein when said actuator provides a load to said drive portion, said control unit adjusts and limits speed of said drive portion in response to the exercising person moving said drive portion.

4. The exercise therapy device according to claim 1, wherein when said actuator provides an assisting force, said control unit adjusts and limits speed of said drive portion in response to the exercising person moving said drive portion.

5. The exercise therapy device according to claim 3, wherein, when said actuator operates as a load device, said control unit adjusts and limits load torque in response to the exercising person moving said drive portion.

6. The exercise therapy device according to claim 1, wherein said control unit produces a load in a rotation stopping mode and a low speed rotation mode of said actuator by supplying a current to said actuator in the rotation stopping mode and the low speed rotation mode.

7. The exercise therapy device according to claim 1, wherein said control unit produces a load, higher than a rated load, by supplying a current, higher than a rated current, to said actuator.

8. The exercise therapy device according to claim 1, further comprising a detector for detecting one of position and angle of a movable part of said drive portion moved by the exercising person, causing movement of said drive portion, wherein said control unit adjusts a load put on the exercising person, based on information on at least one of the position and angle detected by said detector.

9. The exercise therapy device according to claim 8, wherein said control unit stores a reference point of at least one of position and angle of said movable part upon interruption of a power supply that supplies power to said actuator in response to the exercising person moving said drive portion.

10. The exercise therapy device according to claim 1, wherein an electric current flowing through said actuator is reversed by said control unit, so that said actuator reverses direction of rotation.

11. The exercise therapy device according to claim 1, wherein said control unit limits load torque, increased to a first value in a low speed region, to a second value when controlling the load at a constant power consumption, the first value being larger than that of the second value.

12. The exercise therapy device according to claim 11, wherein said control unit adjusts load torque, in a low speed region, in correspondence with physical ability of the exercising person, while taking into consideration available physical strength, so that the load torque is limited at a constant power consumption.

13. The exercise therapy device according to claim 3, wherein said control unit adjusts speed and load of said drive portion, and adjusts the load applied to said drive portion so that the speed at which an exercising person moves said drive portion is a fixed speed even when the exercising person tries to increase the speed beyond the fixed speed.

14. The exercise therapy device according to claim 13, wherein said control unit has a load control parameter and adjusts and determines response of said actuator in accordance with the load control parameter.

15. The exercise therapy device according to claim 14, wherein said control unit sets operator preference of said exercise therapy device by changing the load control parameter when the exercising person moves said drive portion.

16. The exercise therapy device according to claim 14, wherein said control unit sets the load control parameter in correspondence with individual exercises.

17. The exercise therapy device according to claim 1, further comprising a speed detector for detecting speed of a movable part when said drive portion is moved by the exercising person, wherein said control unit has an overspeed protection function for preventing, based on detected-speed information from said speed detector, the movable part from being moved beyond at least one of a mechanical limit and an electrical limit.

18. The exercise therapy device according to claim 1, further comprising a current detector for detecting a current flowing through said actuator, wherein said control unit has overcurrent protection, preventing, based on detected current information from said current detector, an overcurrent which would cause burning of said control unit.

19. The exercise therapy device according to claim 1, further comprising a current detector for detecting a current flowing through said actuator, wherein said control unit has overload protection preventing, based on detected-current information from said current detector, said actuator from burning owing to an excessive amount of heat.

20. The exercise therapy device according to claim 1, wherein said control unit sets and adjusts operator preference of said exercise therapy device by setting and adjusting mechanical parameters which include a spring constant, a viscosity coefficient, and an inertia coefficient.

21. The exercise therapy device according to claim 1, wherein said control unit measures an equivalent mechanical parameter of a leg of the exercising person as a parameter including a spring constant, a viscosity coefficient, and an inertia coefficient.

* * * * *